US009166348B2

(12) United States Patent
Burris et al.

(10) Patent No.: US 9,166,348 B2
(45) Date of Patent: Oct. 20, 2015

(54) COAXIAL CONNECTOR WITH INHIBITED INGRESS AND IMPROVED GROUNDING

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 287 days.

(21) Appl. No.: 13/084,099

(22) Filed: Apr. 11, 2011

(65) Prior Publication Data

US 2011/0250789 A1 Oct. 13, 2011

Related U.S. Application Data

(60) Provisional application No. 61/323,597, filed on Apr. 13, 2010.

(51) Int. Cl.

| | |
|---|---|
| ***H01R 9/05*** | (2006.01) |
| ***H01R 24/40*** | (2011.01) |
| ***H01R 13/52*** | (2006.01) |
| ***H01R 13/622*** | (2006.01) |
| ***H01R 13/6584*** | (2011.01) |
| ***H01R 13/6593*** | (2011.01) |
| *H01R 4/30* | (2006.01) |
| *H01R 13/631* | (2006.01) |
| *H01R 13/6471* | (2011.01) |

(52) U.S. Cl.

CPC ..... *H01R 24/40* (2013.01); *H01R 13/5205* (2013.01); *H01R 13/622* (2013.01); *H01R 13/6584* (2013.01); *H01R 13/6593* (2013.01); *H01R 4/304* (2013.01); *H01R 13/631* (2013.01); *H01R 13/6471* (2013.01)

(58) Field of Classification Search

USPC ..... 439/578, 322, 583–585

See application file for complete search history.

(56) References Cited

U.S. PATENT DOCUMENTS

| | | | | |
|---|---|---|---|---|
| 331,169 | A | 11/1885 | Thomas | |
| 346,958 | A | 8/1886 | Stone | |
| 589,216 | A | 8/1897 | McKee | |
| 1,371,742 | A | 3/1921 | Dringman | |
| 1,488,175 | A | 3/1924 | Strandell | |
| 1,667,485 | A | 4/1928 | Macdonald | |
| 1,766,869 | A | 6/1930 | Austin | |
| 1,801,999 | A | 4/1931 | Bowman | |
| 1,885,761 | A | 11/1932 | Peirce, Jr. | |
| 1,959,302 | A | 5/1934 | Paige | 174/47 |

(Continued)

FOREIGN PATENT DOCUMENTS

| | | |
|---|---|---|
| CA | 2096710 | 11/1994 |
| CN | 201149936 Y | 11/2008 |

(Continued)

OTHER PUBLICATIONS

Lock Washers, ASME B18.21.1-1999, 1999 American Society of Mechanical Engineers, 28 pages.

(Continued)

*Primary Examiner* — Hien Vu

(57) ABSTRACT

A coaxial connector includes a body, a post, a coupling nut, and a sealing member. The sealing member is axially compressed between a rear end facing surface of the coupling nut and a front end facing surface of the hollow body in order to facilitate improved grounding and RF shielding characteristics.

17 Claims, 15 Drawing Sheets

(56) References Cited

U.S. PATENT DOCUMENTS

| | | | | |
|---|---|---|---|---|
| 2,013,526 | A | 9/1935 | Schmitt | |
| 2,059,920 | A | 11/1936 | Weatherhead, Jr. | |
| 2,102,495 | A | 12/1937 | England | 151/35 |
| 2,258,528 | A | 10/1941 | Wurzburger | |
| 2,258,737 | A | 10/1941 | Browne | 173/332 |
| 2,325,549 | A | 7/1943 | Ryzowitz | 174/110 |
| 2,480,963 | A | 9/1949 | Quinn | 173/328 |
| 2,544,654 | A | 3/1951 | Brown | 206/46 |
| 2,549,647 | A | 4/1951 | Turenne | 173/328 |
| 2,694,187 | A | 11/1954 | Nash | 339/14 |
| 2,705,652 | A | 4/1955 | Kaiser | |
| 2,754,487 | A | 7/1956 | Carr et al. | 339/102 |
| 2,755,331 | A | 7/1956 | Melcher | 174/87 |
| 2,757,351 | A | 7/1956 | Klostermann | 339/177 |
| 2,762,025 | A | 9/1956 | Melcher | 339/143 |
| 2,785,384 | A | 3/1957 | Wickesser | |
| 2,805,399 | A | 9/1957 | Leeper | 133/6 |
| 2,816,949 | A | 12/1957 | Curtiss | |
| 2,870,420 | A | 1/1959 | Malek | 333/33 |
| 2,878,039 | A | 3/1959 | Hoegee et al. | |
| 2,881,406 | A | 4/1959 | Arson | |
| 2,963,536 | A | 12/1960 | Kokalas | |
| 3,001,169 | A | 9/1961 | Blonder | 339/177 |
| 3,015,794 | A | 1/1962 | Kishbaugh | |
| 3,051,925 | A | 8/1962 | Felts | |
| 3,091,748 | A | 5/1963 | Takes et al. | 339/65 |
| 3,094,364 | A | 6/1963 | Lingg | 339/64 |
| 3,103,548 | A | 9/1963 | Concelman | |
| 3,140,106 | A | 7/1964 | Thomas et al. | |
| 3,184,706 | A | 5/1965 | Atkins | 339/177 |
| 3,194,292 | A | 7/1965 | Borowsky | 151/35 |
| 3,196,382 | A | 7/1965 | Morello, Jr. | 339/177 |
| 3,206,540 | A | 9/1965 | Cohen | |
| 3,245,027 | A | 4/1966 | Ziegler, Jr. | 339/89 |
| 3,275,913 | A | 9/1966 | Blanchard et al. | 317/249 |
| 3,278,890 | A | 10/1966 | Cooney | 339/256 |
| 3,281,756 | A | 10/1966 | O'Keefe et al. | |
| 3,281,757 | A | 10/1966 | Bonhomme | 339/91 |
| 3,290,069 | A | 12/1966 | Davis | |
| 3,292,136 | A | 12/1966 | Somerset | 339/177 |
| 3,320,575 | A | 5/1967 | Brown et al. | 339/268 |
| 3,321,732 | A | 5/1967 | Forney, Jr. | 339/89 |
| 3,336,563 | A | 8/1967 | Hyslop | 339/61 |
| 3,348,186 | A | 10/1967 | Rosen | 338/214 |
| 3,350,667 | A | 10/1967 | Shreve | 333/71 |
| 3,350,677 | A | 10/1967 | Daum | |
| 3,355,698 | A | 11/1967 | Keller | 339/97 |
| 3,372,364 | A | 3/1968 | O'Keefe et al. | |
| 3,373,243 | A | 3/1968 | Janowiak et al. | 174/89 |
| 3,390,374 | A | 6/1968 | Forney, Jr. | 339/177 |
| 3,406,373 | A | 10/1968 | Forney, Jr. | 339/97 |
| 3,430,184 | A | 2/1969 | Acord | 339/45 |
| 3,448,430 | A | 6/1969 | Kelly | 339/143 |
| 3,453,376 | A | 7/1969 | Ziegler, Jr. et al. | 174/75 |
| 3,465,281 | A | 9/1969 | Florey | 339/89 |
| 3,475,545 | A | 10/1969 | Stark et al. | 174/88 |
| 3,494,400 | A | 2/1970 | McCoy et al. | 151/38 |
| 3,498,647 | A | 3/1970 | Schroder | 285/343 |
| 3,499,671 | A | 3/1970 | Osborne | |
| 3,501,737 | A | 3/1970 | Harris et al. | 339/177 |
| 3,517,373 | A | 6/1970 | Jamon | 339/94 |
| 3,526,871 | A | 9/1970 | Hobart | 339/177 |
| 3,533,051 | A | 10/1970 | Ziegler, Jr. | 339/177 |
| 3,537,065 | A | 10/1970 | Winston | 339/177 |
| 3,544,705 | A | 12/1970 | Winston | 174/75 |
| 3,551,882 | A | 12/1970 | O'Keefe | 339/177 |
| 3,564,487 | A | 2/1971 | Upstone et al. | 339/258 |
| 3,587,033 | A | 6/1971 | Brorein et al. | 339/89 |
| 3,596,933 | A | 8/1971 | Luckenbill | |
| 3,601,776 | A | 8/1971 | Curl | 339/177 |
| 3,603,912 | A | 9/1971 | Kelly | |
| 3,614,711 | A | 10/1971 | Anderson et al. | |
| 3,622,952 | A | 11/1971 | Hilbert | |
| 3,629,792 | A | 12/1971 | Dorrell | 339/60 M |
| 3,633,150 | A | 1/1972 | Schwartz | 339/36 |
| 3,646,502 | A | 2/1972 | Hutter et al. | 339/89 C |
| 3,663,926 | A | 5/1972 | Brandt | 339/95 B |
| 3,665,371 | A | 5/1972 | Cripps | 339/90 C |
| 3,668,612 | A | 6/1972 | Nepovim | 339/94 C |
| 3,669,472 | A | 6/1972 | Nadsady | 285/87 |
| 3,671,922 | A | 6/1972 | Zerlin et al. | 339/74 R |
| 3,671,926 | A | 6/1972 | Nepovim | |
| 3,678,444 | A | 7/1972 | Stevens et al. | 339/177 R |
| 3,678,445 | A | 7/1972 | Brancaleone | 339/143 R |
| 3,680,034 | A | 7/1972 | Chow et al. | 339/48 |
| 3,681,739 | A | 8/1972 | Kornick | 339/94 C |
| 3,683,320 | A | 8/1972 | Woods et al. | 339/177 E |
| 3,686,623 | A | 8/1972 | Nijman | 339/177 E |
| 3,694,792 | A | 9/1972 | Wallo | 339/97 R |
| 3,694,793 | A | 9/1972 | Concelman | |
| 3,697,930 | A * | 10/1972 | Shirey | 439/322 |
| 3,706,958 | A | 12/1972 | Blanchenot | 339/177 R |
| 3,708,186 | A | 1/1973 | Takagi et al. | |
| 3,710,005 | A | 1/1973 | French | 174/89 |
| 3,739,076 | A | 6/1973 | Schwartz | 174/78 |
| 3,744,007 | A | 7/1973 | Horak | 339/97 R |
| 3,744,011 | A | 7/1973 | Blanchenot | 339/177 R |
| 3,761,870 | A | 9/1973 | Drezin et al. | |
| 3,778,535 | A | 12/1973 | Forney, Jr. | 174/88 C |
| 3,781,762 | A | 12/1973 | Quackenbush | 339/89 C |
| 3,781,898 | A | 12/1973 | Holloway | 343/872 |
| 3,783,178 | A | 1/1974 | Philibert et al. | |
| 3,787,796 | A | 1/1974 | Barr | |
| 3,793,610 | A | 2/1974 | Brishka | 339/74 R |
| 3,798,589 | A | 3/1974 | Deardurff | 339/223 S |
| 3,808,580 | A | 4/1974 | Johnson | 339/89 R |
| 3,810,076 | A | 5/1974 | Hutter | 339/177 R |
| 3,835,443 | A | 9/1974 | Arnold et al. | 339/90 R |
| 3,836,700 | A | 9/1974 | Niemeyer | 174/89 |
| 3,845,453 | A | 10/1974 | Hemmer | 339/59 R |
| 3,846,738 | A | 11/1974 | Nepovim | 339/177 R |
| 3,854,003 | A | 12/1974 | Duret | 174/88 C |
| 3,854,789 | A | 12/1974 | Kaplan | |
| 3,858,156 | A | 12/1974 | Zarro | 339/32 |
| 3,879,102 | A | 4/1975 | Horak | 339/143 R |
| 3,886,301 | A | 5/1975 | Cronin et al. | 174/21 C |
| 3,907,335 | A | 9/1975 | Burge et al. | |
| 3,907,399 | A | 9/1975 | Spinner | 339/177 R |
| 3,910,673 | A | 10/1975 | Stokes | 339/177 R |
| 3,915,539 | A | 10/1975 | Collins | 339/94 C |
| 3,936,132 | A | 2/1976 | Hutter | 339/130 C |
| 3,937,547 | A | 2/1976 | Lee-Kemp | |
| 3,953,097 | A | 4/1976 | Graham | 339/37 |
| 3,960,428 | A | 6/1976 | Naus et al. | 339/90 R |
| 3,963,320 | A | 6/1976 | Spinner | 339/117 R |
| 3,963,321 | A | 6/1976 | Burger et al. | 339/177 E |
| 3,970,355 | A | 7/1976 | Pitschi | 339/177 R |
| 3,972,013 | A | 7/1976 | Shapiro | 339/97 R |
| 3,976,352 | A | 8/1976 | Spinner | 339/177 R |
| 3,980,805 | A | 9/1976 | Lipari | 174/88 C |
| 3,985,418 | A | 10/1976 | Spinner | 339/177 R |
| 3,986,736 | A | 10/1976 | Takagi et al. | |
| 4,017,139 | A | 4/1977 | Nelson | 339/91 R |
| 4,022,966 | A | 5/1977 | Gajajiva | 174/65 SS |
| 4,030,742 | A | 6/1977 | Eidelberg et al. | |
| 4,030,798 | A | 6/1977 | Paoli | 339/89 R |
| 4,032,177 | A | 6/1977 | Anderson | |
| 4,045,706 | A | 8/1977 | Daffner et al. | |
| 4,046,451 | A | 9/1977 | Juds et al. | 339/177 R |
| 4,053,200 | A | 10/1977 | Pugner | |
| 4,453,200 | A | 10/1977 | Pugner | 339/177 R |
| 4,056,043 | A | 11/1977 | Sriramamurty et al. | |
| 4,059,330 | A | 11/1977 | Shirey | 339/177 R |
| 4,079,343 | A | 3/1978 | Nijman | 333/79 |
| 4,082,404 | A | 4/1978 | Flatt | 339/111 |
| 4,090,028 | A | 5/1978 | Vontobel | 174/14 R |
| 4,093,335 | A | 6/1978 | Schwartz et al. | 339/177 E |
| 4,100,943 | A | 7/1978 | Terada et al. | |
| 4,106,839 | A | 8/1978 | Cooper | 339/143 R |
| 4,109,126 | A | 8/1978 | Halbeck | 200/302 |
| 4,125,308 | A | 11/1978 | Schilling | 339/17 LC |
| 4,126,372 | A | 11/1978 | Hashimoto et al. | 339/177 E |
| 4,131,332 | A | 12/1978 | Hogendobler et al. | |
| 4,136,897 | A | 1/1979 | Haluch | |

(56) References Cited

U.S. PATENT DOCUMENTS

| | | | | |
|---|---|---|---|---|
| 4,150,250 | A | 4/1979 | Lundeberg | 174/65 SS |
| 4,153,320 | A | 5/1979 | Townshend | 339/91 B |
| 4,156,554 | A | 5/1979 | Aujla | 339/177 R |
| 4,165,911 | A | 8/1979 | Laudig | 339/89 C |
| 4,168,921 | A | 9/1979 | Blanchard | 403/19 |
| 4,173,385 | A | 11/1979 | Fenn et al. | 339/177 E |
| 4,174,875 | A | 11/1979 | Wilson et al. | 339/91 P |
| 4,187,481 | A | 2/1980 | Bourtos | 333/182 |
| 4,193,655 | A | 3/1980 | Herrmann, Jr. | 339/31 R |
| 4,194,338 | A | 3/1980 | Trafton | |
| 4,206,963 | A | 6/1980 | English et al. | |
| 4,212,487 | A | 7/1980 | Jones et al. | |
| 4,225,162 | A | 9/1980 | Dola | 285/161 |
| 4,227,765 | A | 10/1980 | Neumann et al. | 339/143 R |
| 4,229,714 | A | 10/1980 | Yu | 333/12 |
| 4,250,348 | A | 2/1981 | Kitagawa | 174/65 SS |
| 4,273,405 | A | 6/1981 | Law | 339/94 R |
| 4,280,749 | A | 7/1981 | Hemmer | 339/177 R |
| 4,285,564 | A | 8/1981 | Spinner | 339/89 C |
| 459,951 | A | 9/1981 | Warner | |
| 4,290,663 | A | 9/1981 | Fowler et al. | 339/143 R |
| 4,296,986 | A | 10/1981 | Herrmann, Jr. | 339/89 C |
| 4,307,926 | A | 12/1981 | Smith | 339/177 R |
| 4,309,050 | A | 1/1982 | Legris | |
| 4,310,211 | A | 1/1982 | Bunnell et al. | |
| 4,322,121 | A | 3/1982 | Riches et al. | 339/89 M |
| 4,326,769 | A | 4/1982 | Dorsey et al. | 339/177 E |
| 4,334,730 | A | 6/1982 | Colwell et al. | |
| 4,339,166 | A | 7/1982 | Dayton | 339/100 |
| 4,346,958 | A | 8/1982 | Blanchard | 339/177 R |
| 4,354,721 | A | 10/1982 | Luzzi | 339/94 R |
| 4,358,174 | A | 11/1982 | Dreyer | 339/64 M |
| 4,373,767 | A | 2/1983 | Cairns | 339/94 C |
| 4,389,081 | A | 6/1983 | Gallusser et al. | 339/89 M |
| 4,400,050 | A | 8/1983 | Hayward | 339/177 R |
| 4,407,529 | A | 10/1983 | Holman | 285/82 |
| 4,408,821 | A | 10/1983 | Forney, Jr. | 339/177 R |
| 4,408,822 | A | 10/1983 | Nikitas | 439/583 |
| 4,412,717 | A | 11/1983 | Monroe | 339/177 R |
| 4,421,377 | A | 12/1983 | Spinner | 339/177 R |
| 4,426,127 | A | 1/1984 | Kubota | 339/177 R |
| 4,444,453 | A | 4/1984 | Kirby et al. | 339/177 R |
| 4,452,503 | A | 6/1984 | Forney, Jr. | 339/177 R |
| 4,456,323 | A | 6/1984 | Pitcher et al. | 339/177 R |
| 4,462,653 | A | 7/1984 | Flederbach et al. | 339/89 R |
| 4,464,000 | A | 8/1984 | Werth et al. | 339/89 M |
| 4,464,001 | A | 8/1984 | Collins | 339/90 R |
| 4,469,386 | A | 9/1984 | Ackerman | 339/37 |
| 4,470,657 | A | 9/1984 | Deacon | 339/143 R |
| 4,477,132 | A | 10/1984 | Moser et al. | |
| 4,484,792 | A | 11/1984 | Tengler et al. | 339/143 R |
| 4,484,796 | A | 11/1984 | Sato et al. | 350/96.21 |
| 4,490,576 | A | 12/1984 | Bolante et al. | 174/65 SS |
| 4,506,943 | A | 3/1985 | Drogo | 339/90 R |
| 4,515,427 | A | 5/1985 | Smit | 339/177 E |
| 4,525,017 | A | 6/1985 | Schildkraut et al. | 339/89 M |
| 4,531,790 | A | 7/1985 | Selvin | 339/14 R |
| 4,531,805 | A | 7/1985 | Werth | 339/143 R |
| 4,533,191 | A | 8/1985 | Blackwood | 339/31 R |
| 4,540,231 | A | 9/1985 | Forney, Jr. | 339/94 C |
| RE31,995 | E | 10/1985 | Ball | 339/113 R |
| 4,545,633 | A | 10/1985 | McGeary | |
| 4,545,637 | A | 10/1985 | Bosshard et al. | 339/177 E |
| 4,575,274 | A | 3/1986 | Hayward | 403/2 |
| 4,580,862 | A | 4/1986 | Johnson | 339/64 R |
| 4,580,865 | A | 4/1986 | Fryberger | 339/103 M |
| 4,583,811 | A | 4/1986 | McMills | 339/177 R |
| 4,585,289 | A | 4/1986 | Bocher | 339/89 C |
| 4,588,246 | A | 5/1986 | Schildkraut et al. | 339/89 R |
| 4,593,964 | A | 6/1986 | Forney, Jr. et al. | 339/177 R |
| 4,596,434 | A | 6/1986 | Saba et al. | 339/177 R |
| 4,596,435 | A | 6/1986 | Bickford | 339/177 R |
| 4,597,621 | A | 7/1986 | Burns | 339/90 R |
| 4,598,959 | A | 7/1986 | Selvin | 339/14 R |
| 4,598,961 | A | 7/1986 | Cohen | 339/17 C |
| 4,600,263 | A | 7/1986 | DeChamp et al. | 339/177 R |
| 4,613,199 | A | 9/1986 | McGeary | 339/177 R |
| 4,614,390 | A | 9/1986 | Baker | 339/61 R |
| 4,616,900 | A | 10/1986 | Cairns | 350/96.2 |
| 4,632,487 | A | 12/1986 | Wargula | 339/103 B |
| 4,634,213 | A | 1/1987 | Larsson et al. | 339/275 T |
| 4,640,572 | A | 2/1987 | Conlon | 339/252 R |
| 4,645,281 | A | 2/1987 | Burger | 339/37 |
| 4,647,135 | A | 3/1987 | Reinhardt | 339/103 R |
| 4,650,228 | A | 3/1987 | McMills et al. | 285/381 |
| 4,655,159 | A | 4/1987 | McMills | 116/212 |
| 4,655,534 | A | 4/1987 | Stursa | 339/177 R |
| 4,660,921 | A | 4/1987 | Hauver | 339/177 R |
| 4,666,190 | A | 5/1987 | Yamabe et al. | |
| 4,668,043 | A | 5/1987 | Saba et al. | 339/177 R |
| 4,673,236 | A | 6/1987 | Musolff et al. | 439/609 |
| 4,674,818 | A | 6/1987 | McMills et al. | 439/275 |
| 4,676,577 | A | 6/1987 | Szegda | 439/584 |
| 4,682,832 | A | 7/1987 | Punako et al. | 439/589 |
| 4,684,201 | A | 8/1987 | Hutter | 439/585 |
| 4,688,876 | A | 8/1987 | Morelli | 439/578 |
| 4,688,878 | A | 8/1987 | Cohen et al. | 439/585 |
| 4,690,482 | A | 9/1987 | Chamberland et al. | 439/578 |
| 4,691,976 | A | 9/1987 | Cowen | 439/394 |
| 4,703,987 | A | 11/1987 | Gallusser et al. | 439/595 |
| 4,703,988 | A | 11/1987 | Raux et al. | 439/321 |
| 4,713,021 | A | 12/1987 | Kobler | |
| 4,717,355 | A | 1/1988 | Mattis | 439/452 |
| 4,720,155 | A | 1/1988 | Schildkraut et al. | 439/108 |
| 4,728,301 | A | 3/1988 | Hemmer et al. | |
| 4,734,050 | A | 3/1988 | Negre et al. | 439/289 |
| 4,734,666 | A | 3/1988 | Ohya et al. | 333/230 |
| 4,737,123 | A | 4/1988 | Paler et al. | 439/607 |
| 4,738,009 | A | 4/1988 | Down et al. | |
| 4,738,628 | A | 4/1988 | Rees | 439/95 |
| 4,739,009 | A | 4/1988 | Down et al. | 29/33 M |
| 4,739,126 | A | 4/1988 | Gutter et al. | |
| 4,746,305 | A | 5/1988 | Nomura | 439/319 |
| 4,747,656 | A | 5/1988 | Miyahara et al. | |
| 4,747,786 | A | 5/1988 | Hayashi et al. | 439/95 |
| 4,749,821 | A | 6/1988 | Linton et al. | 174/35 R |
| 4,755,152 | A | 7/1988 | Elliott et al. | 439/452 |
| 4,757,297 | A | 7/1988 | Frawley | 338/214 |
| 4,759,729 | A | 7/1988 | Kemppainen et al. | 439/580 |
| 4,761,146 | A | 8/1988 | Sohoel | 439/584 |
| 4,772,222 | A | 9/1988 | Laudig et al. | 439/578 |
| 4,789,355 | A | 12/1988 | Lee | 439/584 |
| 4,789,759 | A | 12/1988 | Jones | |
| 4,795,360 | A | 1/1989 | Newman et al. | 439/278 |
| 4,797,120 | A | 1/1989 | Ulery | 439/578 |
| 4,806,116 | A | 2/1989 | Ackerman | 439/304 |
| 4,807,891 | A | 2/1989 | Neher | 277/80 |
| 4,808,128 | A | 2/1989 | Werth | 439/610 |
| 4,810,017 | A | 3/1989 | Knak et al. | |
| 4,813,886 | A | 3/1989 | Roos et al. | 439/578 |
| 4,820,185 | A | 4/1989 | Moulin | 439/321 |
| 4,834,675 | A | 5/1989 | Samchisen | 439/578 |
| 4,834,676 | A | 5/1989 | Tackett | |
| 4,835,342 | A | 5/1989 | Guginsky | 174/65 |
| 4,836,580 | A | 6/1989 | Farrell | |
| 4,836,801 | A | 6/1989 | Ramirez | 439/322 |
| 4,838,813 | A | 6/1989 | Pauza et al. | 439/620 |
| 4,846,731 | A | 7/1989 | Alwine | |
| 4,854,893 | A | 8/1989 | Morris | 439/578 |
| 4,857,014 | A | 8/1989 | Alf et al. | 439/578 |
| 4,867,489 | A | 9/1989 | Patel | |
| 4,867,706 | A | 9/1989 | Tang | 439/620 |
| 4,869,679 | A | 9/1989 | Szegda | 439/272 |
| 4,874,331 | A | 10/1989 | Iverson | 439/449 |
| 4,881,912 | A | 11/1989 | Thommen et al. | |
| 4,892,275 | A | 1/1990 | Szegda | 248/61 |
| 4,902,246 | A | 2/1990 | Samchisen | 439/578 |
| 4,906,207 | A | 3/1990 | Banning et al. | 439/578 |
| 4,915,651 | A | 4/1990 | Bout | 439/578 |
| 4,921,447 | A | 5/1990 | Capp et al. | 439/585 |
| 4,923,412 | A | 5/1990 | Morris | 439/578 |
| 4,925,403 | A | 5/1990 | Zorzy | 439/578 |
| 4,927,385 | A | 5/1990 | Cheng | 439/578 |
| 4,929,188 | A | 5/1990 | Lionetto et al. | 439/349 |

(56) References Cited

U.S. PATENT DOCUMENTS

| | | | | |
|---|---|---|---|---|
| 4,934,960 | A | 6/1990 | Capp et al. | 439/620 |
| 4,938,718 | A | 7/1990 | Guendel | 439/680 |
| 4,941,846 | A | 7/1990 | Guimond et al. | 439/578 |
| 4,952,174 | A | 8/1990 | Sucht et al. | 439/584 |
| 4,957,456 | A | 9/1990 | Olson et al. | 439/578 |
| 4,973,265 | A | 11/1990 | Heeren | 439/584 |
| 4,979,911 | A | 12/1990 | Spencer | 439/583 |
| 4,990,104 | A | 2/1991 | Schieferly | 439/578 |
| 4,990,105 | A | 2/1991 | Karlovich | 439/578 |
| 4,990,106 | A | 2/1991 | Szegda | 439/585 |
| 4,992,061 | A | 2/1991 | Brush, Jr. et al. | 439/620 |
| 5,002,503 | A | 3/1991 | Campbell et al. | 439/578 |
| 5,007,861 | A | 4/1991 | Stirling | 439/578 |
| 5,011,422 | A | 4/1991 | Yeh | 409/307 |
| 5,011,432 | A | 4/1991 | Sucht et al. | 439/584 |
| 5,018,822 | A | 5/1991 | Freismuth et al. | |
| 5,021,010 | A | 6/1991 | Wright | 439/578 |
| 5,024,606 | A | 6/1991 | Ming-Hwa | 439/578 |
| 5,030,126 | A | 7/1991 | Hanlon | 439/320 |
| 5,037,328 | A | 8/1991 | Karlovich | 439/578 |
| 5,046,964 | A | 9/1991 | Welsh et al. | 439/271 |
| 5,052,947 | A | 10/1991 | Brodie et al. | 439/607 |
| 5,055,060 | A | 10/1991 | Down et al. | 439/304 |
| 5,059,139 | A | 10/1991 | Spinner | |
| 5,059,747 | A | 10/1991 | Bawa et al. | 174/65 SS |
| 5,062,804 | A | 11/1991 | Jamet et al. | 439/394 |
| 5,066,248 | A | 11/1991 | Gaver, Jr. et al. | 439/578 |
| 5,067,912 | A | 11/1991 | Bickford et al. | |
| 5,073,129 | A | 12/1991 | Szegda | 439/585 |
| 5,080,600 | A | 1/1992 | Baker et al. | 439/258 |
| 5,083,943 | A | 1/1992 | Tarrant | 439/583 |
| 5,120,260 | A | 6/1992 | Jackson | 439/585 |
| 5,127,853 | A | 7/1992 | McMills et al. | 439/578 |
| 5,131,862 | A | 7/1992 | Gershfeld | 439/357 |
| 5,137,470 | A | 8/1992 | Doles | 439/578 |
| 5,137,471 | A | 8/1992 | Verespej et al. | 439/585 |
| 5,141,448 | A | 8/1992 | Mattingly et al. | 439/314 |
| 5,141,451 | A | 8/1992 | Down | 439/585 |
| 5,149,274 | A | 9/1992 | Gallusser et al. | 439/76 |
| 5,150,924 | A | 9/1992 | Yokomatsu et al. | |
| 5,154,636 | A | 10/1992 | Vaccaro et al. | 439/583 |
| 5,161,993 | A | 11/1992 | Leibfried, Jr. | 439/320 |
| 5,166,477 | A | 11/1992 | Perin, Jr. et al. | 174/74 R |
| 5,167,545 | A | 12/1992 | O'Brien et al. | 439/874 |
| 5,169,323 | A | 12/1992 | Kawai et al. | 439/95 |
| 5,181,161 | A | 1/1993 | Hirose et al. | 369/48 |
| 5,183,417 | A | 2/1993 | Bools | |
| 5,185,655 | A | 2/1993 | Glenday et al. | 439/583 |
| 5,186,501 | A | 2/1993 | Mano | 285/89 |
| 5,186,655 | A | 2/1993 | Glenday et al. | |
| 5,195,905 | A | 3/1993 | Pesci | 439/352 |
| 5,195,906 | A | 3/1993 | Szegda | 439/394 |
| 5,205,547 | A | 4/1993 | Mattingly | 267/158 |
| 5,205,761 | A | 4/1993 | Nilsson | 439/578 |
| 5,207,602 | A | 5/1993 | McMills et al. | 439/836 |
| 5,215,477 | A | 6/1993 | Weber et al. | 439/581 |
| 5,217,391 | A | 6/1993 | Fisher, Jr. | 439/578 |
| 5,217,392 | A | 6/1993 | Hosler, Sr. | |
| 5,217,393 | A | 6/1993 | Del Negro et al. | 439/585 |
| 5,221,216 | A | 6/1993 | Gabany et al. | 439/620 |
| 5,227,587 | A | 7/1993 | Paterek | 174/152 GM |
| 5,247,424 | A | 9/1993 | Harris et al. | 361/704 |
| 5,269,701 | A | 12/1993 | Leibfried, Jr. | 439/578 |
| 5,281,762 | A | 1/1994 | Long et al. | 174/78 |
| 5,283,853 | A | 2/1994 | Szegda | 385/139 |
| 5,284,449 | A | 2/1994 | Vaccaro | 439/583 |
| 5,294,864 | A | 3/1994 | Do | |
| 5,294,964 | A | 3/1994 | Do | 315/39.51 |
| 5,295,864 | A | 3/1994 | Birch et al. | 439/578 |
| 5,316,348 | A * | 5/1994 | Franklin | 285/39 |
| 5,316,494 | A | 5/1994 | Flanagan et al. | 439/352 |
| 5,318,459 | A | 6/1994 | Sheilds | 439/527 |
| 5,321,205 | A | 6/1994 | Bawa et al. | |
| 5,334,032 | A | 8/1994 | Myers et al. | 439/140 |
| 5,334,051 | A | 8/1994 | Devine et al. | 439/583 |
| 5,338,225 | A | 8/1994 | Jacobsen et al. | 439/585 |
| 5,342,218 | A | 8/1994 | McMills et al. | 439/578 |
| 5,354,217 | A | 10/1994 | Gabel et al. | 439/583 |
| 5,362,250 | A | 11/1994 | McMills et al. | 439/387 |
| 5,362,251 | A | 11/1994 | Bielak | |
| 5,366,260 | A | 11/1994 | Wartluft | |
| 5,371,819 | A | 12/1994 | Szegda | 385/75 |
| 5,371,821 | A | 12/1994 | Szegda | 385/87 |
| 5,371,827 | A | 12/1994 | Szegda | 385/136 |
| 5,380,211 | A | 1/1995 | Kawagachi et al. | 439/74 |
| 5,389,005 | A | 2/1995 | Kodama | 439/272 |
| 5,393,244 | A | 2/1995 | Szegda | 439/394 |
| 5,397,252 | A | 3/1995 | Wang | 439/620 |
| 5,413,504 | A | 5/1995 | Kloecker et al. | 439/620 |
| 5,431,583 | A | 7/1995 | Szegda | 439/589 |
| 5,435,745 | A | 7/1995 | Booth | 439/584 |
| 5,435,751 | A | 7/1995 | Papenheim et al. | 439/589 |
| 5,435,760 | A | 7/1995 | Miklos | |
| 5,439,386 | A | 8/1995 | Ellis et al. | 439/322 |
| 5,444,810 | A | 8/1995 | Szegda | 385/139 |
| 5,455,548 | A | 10/1995 | Grandchamp et al. | 333/260 |
| 5,456,611 | A | 10/1995 | Henry et al. | 439/180 |
| 5,456,614 | A | 10/1995 | Szegda | 439/321 |
| 5,466,173 | A | 11/1995 | Down | |
| 5,470,257 | A | 11/1995 | Szegda | 439/578 |
| 5,474,478 | A | 12/1995 | Ballog | 439/805 |
| 5,488,268 | A | 1/1996 | Bauer et al. | |
| 5,490,033 | A | 2/1996 | Cronin | 361/212 |
| 5,490,801 | A | 2/1996 | Fisher, Jr. et al. | 439/585 |
| 5,494,454 | A | 2/1996 | Johnsen | 439/394 |
| 5,499,934 | A | 3/1996 | Jacobsen et al. | 439/585 |
| 5,501,616 | A | 3/1996 | Holliday | 439/585 |
| 5,516,303 | A | 5/1996 | Yohn et al. | 439/248 |
| 5,525,076 | A | 6/1996 | Down | 439/585 |
| 5,542,861 | A | 8/1996 | Anhalt et al. | 439/578 |
| 5,548,088 | A | 8/1996 | Gray et al. | 174/74 R |
| 5,550,521 | A | 8/1996 | Bernaud et al. | 333/260 |
| 5,564,938 | A | 10/1996 | Shenkal et al. | 439/301 |
| 5,571,028 | A | 11/1996 | Szegda | 439/322 |
| 5,586,910 | A | 12/1996 | Del Negro et al. | 439/584 |
| 5,595,499 | A | 1/1997 | Zander et al. | 439/352 |
| 5,598,132 | A | 1/1997 | Stabile | 333/22 R |
| 5,607,320 | A | 3/1997 | Wright | |
| 5,607,325 | A | 3/1997 | Toma | 439/578 |
| 5,609,501 | A | 3/1997 | McMills et al. | |
| 5,620,339 | A | 4/1997 | Gray et al. | 439/578 |
| 5,632,637 | A | 5/1997 | Diener | 439/188 |
| 5,632,651 | A | 5/1997 | Szegda | 439/578 |
| 5,644,104 | A | 7/1997 | Porter et al. | 174/65 R |
| 5,649,723 | A | 7/1997 | Larsson | |
| 5,651,698 | A | 7/1997 | Locati et al. | 439/578 |
| 5,651,699 | A | 7/1997 | Holliday | 439/585 |
| 5,653,605 | A | 8/1997 | Woehl et al. | 439/321 |
| 5,667,405 | A | 9/1997 | Holliday | 439/585 |
| 5,681,172 | A | 10/1997 | Moldenhauer | 439/95 |
| 5,683,263 | A | 11/1997 | Hsu | 439/319 |
| 5,702,263 | A | 12/1997 | Baumann et al. | 439/321 |
| 5,722,856 | A | 3/1998 | Fuchs et al. | 439/578 |
| 5,735,704 | A | 4/1998 | Anthony | 439/271 |
| 5,743,131 | A | 4/1998 | Holliday et al. | |
| 5,746,617 | A | 5/1998 | Porter, Jr. et al. | 439/248 |
| 5,746,619 | A | 5/1998 | Harting et al. | 439/352 |
| 5,769,652 | A | 6/1998 | Wider | 439/248 |
| 5,774,344 | A | 6/1998 | Casebolt | |
| 5,775,927 | A | 7/1998 | Wider | |
| 5,788,289 | A | 8/1998 | Cronley | |
| 5,791,698 | A | 8/1998 | Wartluft et al. | |
| 5,797,633 | A | 8/1998 | Katzer et al. | |
| 5,817,978 | A | 10/1998 | Hermant et al. | |
| 5,863,220 | A | 1/1999 | Holliday | 439/584 |
| 5,877,452 | A | 3/1999 | McConnell | 174/88 C |
| 5,879,191 | A | 3/1999 | Burris | 439/584 |
| 5,882,226 | A | 3/1999 | Bell et al. | 439/582 |
| 5,897,795 | A | 4/1999 | Lu et al. | |
| 5,906,511 | A | 5/1999 | Bozzer et al. | |
| 5,917,153 | A | 6/1999 | Geroldinger | |
| 5,921,793 | A | 7/1999 | Phillips | 439/188 |
| 5,938,465 | A | 8/1999 | Fox, Sr. | 439/350 |
| 5,944,548 | A | 8/1999 | Saito | 439/248 |

(56) References Cited

U.S. PATENT DOCUMENTS

| | | | | |
|---|---|---|---|---|
| 5,951,327 | A | 9/1999 | Marik | |
| 5,954,708 | A | 9/1999 | Lopez et al. | |
| 5,957,716 | A | 9/1999 | Buckley et al. | 439/321 |
| 5,967,852 | A | 10/1999 | Follingstad et al. | 439/675 |
| 5,975,479 | A | 11/1999 | Suter | |
| 5,975,591 | A | 11/1999 | Guest | |
| 5,975,949 | A | 11/1999 | Holliday et al. | 439/585 |
| 5,975,951 | A | 11/1999 | Burris et al. | 439/585 |
| 5,977,841 | A | 11/1999 | Lee et al. | 333/24 C |
| 5,997,350 | A | 12/1999 | Burris et al. | 439/585 |
| 6,010,349 | A | 1/2000 | Porter, Jr. | 439/320 |
| 6,019,635 | A | 2/2000 | Nelson | 439/583 |
| 6,022,237 | A | 2/2000 | Esh | 439/348 |
| 6,032,358 | A | 3/2000 | Wild | 29/863 |
| 6,036,540 | A | 3/2000 | Beloritsky | |
| 6,042,422 | A | 3/2000 | Youtsey | 439/585 |
| 6,048,229 | A | 4/2000 | Lazaro, Jr. | 439/681 |
| 6,053,743 | A | 4/2000 | Mitchell et al. | 439/63 |
| 6,053,769 | A | 4/2000 | Kubota et al. | 439/578 |
| 6,053,777 | A | 4/2000 | Boyle | 439/700 |
| 6,062,607 | A | 5/2000 | Barthloomew | |
| 6,080,015 | A | 6/2000 | Andreescu | |
| 6,083,053 | A | 7/2000 | Anderson, Jr. et al. | 439/687 |
| 6,089,903 | A | 7/2000 | Stafford Gray et al. | 439/439 |
| 6,089,912 | A | 7/2000 | Tallis et al. | 439/584 |
| 6,089,913 | A | 7/2000 | Holliday | |
| 6,093,043 | A | 7/2000 | Gray et al. | |
| 6,095,828 | A | 8/2000 | Burland | |
| 6,095,841 | A | 8/2000 | Felps | |
| 6,123,550 | A | 9/2000 | Burkert et al. | |
| 6,123,567 | A | 9/2000 | McCarthy | 439/427 |
| 6,132,234 | A | 10/2000 | Waidner et al. | |
| 6,146,197 | A | 11/2000 | Holliday et al. | 439/585 |
| 6,152,752 | A | 11/2000 | Fukuda | 439/275 |
| 6,152,753 | A | 11/2000 | Johnson et al. | |
| 6,153,830 | A | 11/2000 | Montena | |
| 6,162,995 | A | 12/2000 | Bachle et al. | |
| 6,164,977 | A | 12/2000 | Lester | |
| 6,174,206 | B1 | 1/2001 | Yentile et al. | |
| 6,183,298 | B1 | 2/2001 | Henningsen | |
| 6,199,913 | B1 | 3/2001 | Wang | |
| 6,199,920 | B1 | 3/2001 | Neustadtl | |
| 6,210,216 | B1 | 4/2001 | Tso-Chin et al. | |
| 6,210,219 | B1 | 4/2001 | Zhu et al. | 439/567 |
| 6,210,222 | B1 | 4/2001 | Langham et al. | 439/583 |
| 6,217,383 | B1 | 4/2001 | Holland et al. | 439/578 |
| 6,238,240 | B1 | 5/2001 | Yu | |
| 6,239,359 | B1 | 5/2001 | Lilienthal, II et al. | 174/35 GC |
| 6,241,553 | B1 | 6/2001 | Hsia | 439/578 |
| 6,250,974 | B1 | 6/2001 | Kerek | |
| 6,257,923 | B1 | 7/2001 | Stone et al. | 439/502 |
| 6,261,126 | B1 | 7/2001 | Stirling | 439/583 |
| 6,267,612 | B1 | 7/2001 | Areykiewicz et al. | 439/253 |
| 6,271,464 | B1 | 8/2001 | Cunningham | 174/35 R |
| 6,331,123 | B1 | 12/2001 | Rodrigues | 439/584 |
| 6,332,815 | B1 | 12/2001 | Bruce | 439/862 |
| 6,352,448 | B1 | 3/2002 | Holliday et al. | |
| 6,358,077 | B1 | 3/2002 | Young | 439/321 |
| 6,361,348 | B1 | 3/2002 | Hall et al. | |
| 6,361,364 | B1 | 3/2002 | Holland et al. | |
| 6,375,509 | B2 | 4/2002 | Mountford | |
| 6,394,840 | B1 | 5/2002 | Gassauer et al. | |
| 6,396,367 | B1 | 5/2002 | Rosenberger | |
| D458,904 | S | 6/2002 | Montena | D13/154 |
| 6,406,330 | B2 | 6/2002 | Bruce | 439/609 |
| 6,409,534 | B1 | 6/2002 | Weisz-Margulescu | |
| D460,739 | S | 7/2002 | Fox | D13/154 |
| D460,740 | S | 7/2002 | Montena | D13/154 |
| D460,946 | S | 7/2002 | Montena | D13/154 |
| D460,947 | S | 7/2002 | Montena | D13/154 |
| D460,948 | S | 7/2002 | Montena | D13/154 |
| 6,422,884 | B1 | 7/2002 | Babasick et al. | |
| 6,422,900 | B1 | 7/2002 | Hogan | 439/578 |
| 6,425,782 | B1 | 7/2002 | Holland | 439/585 |
| D461,166 | S | 8/2002 | Montena | D13/151 |
| D461,167 | S | 8/2002 | Montena | D13/154 |
| D461,778 | S | 8/2002 | Fox | D13/151 |
| D462,058 | S | 8/2002 | Montena | D13/151 |
| D462,060 | S | 8/2002 | Fox | D13/154 |
| 6,439,899 | B1 | 8/2002 | Muzslay et al. | 439/98 |
| D462,327 | S | 9/2002 | Montena | D13/151 |
| 6,450,829 | B1 | 9/2002 | Weisz-Margulescu | |
| 6,454,463 | B1 | 9/2002 | Halbach | |
| 6,464,526 | B1 | 10/2002 | Seufert et al. | |
| 6,467,816 | B1 | 10/2002 | Huang | |
| 6,468,100 | B1 | 10/2002 | Meyer et al. | 439/320 |
| 6,491,546 | B1 | 12/2002 | Perry | 439/620 |
| D468,696 | S | 1/2003 | Montena | D13/151 |
| 6,506,083 | B1 | 1/2003 | Bickford et al. | 439/736 |
| 6,520,800 | B1 | 2/2003 | Michelbach et al. | 439/578 |
| 6,530,807 | B2 | 3/2003 | Rodrigues et al. | 439/578 |
| 6,540,531 | B2 | 4/2003 | Syed et al. | 439/98 |
| 6,558,194 | B2 | 5/2003 | Montena | 439/585 |
| 6,572,419 | B2 | 6/2003 | Feye-Homann | 439/839 |
| 6,576,833 | B2 | 6/2003 | Covaro et al. | 174/35 GC |
| 6,619,876 | B2 | 9/2003 | Vaitkus et al. | 403/349 |
| 6,634,906 | B1 | 10/2003 | Yeh | 439/585 |
| 6,663,397 | B1 | 12/2003 | Lin et al. | |
| 6,676,446 | B2 | 1/2004 | Montena | 439/583 |
| 6,683,253 | B1 | 1/2004 | Lee | 174/75 |
| 6,692,285 | B2 | 2/2004 | Islam | 439/352 |
| 6,692,286 | B1 | 2/2004 | De Cet | 439/352 |
| 6,695,636 | B2 | 2/2004 | Hall et al. | |
| 6,705,875 | B2 | 3/2004 | Berghorn et al. | |
| 6,705,884 | B1 | 3/2004 | McCarthy | 439/394 |
| 6,709,280 | B1 | 3/2004 | Gretz | |
| 6,712,631 | B1 | 3/2004 | Youtsey | 439/322 |
| 6,716,041 | B2 | 4/2004 | Ferderer et al. | 439/95 |
| 6,716,062 | B1 | 4/2004 | Palinkas et al. | 439/578 |
| 6,733,336 | B1 | 5/2004 | Montena et al. | 439/578 |
| 6,733,337 | B2 | 5/2004 | Kodaira | 439/578 |
| 6,752,633 | B2 | 6/2004 | Aizawa et al. | 439/63 |
| 6,761,571 | B2 | 7/2004 | Hida | |
| 6,767,248 | B1 | 7/2004 | Hung | 439/578 |
| 6,769,926 | B1 | 8/2004 | Montena | 439/253 |
| 6,780,029 | B1 | 8/2004 | Gretz | |
| 6,780,042 | B1 | 8/2004 | Badescu et al. | |
| 6,780,052 | B2 | 8/2004 | Montena et al. | |
| 6,780,068 | B2 | 8/2004 | Bartholoma et al. | 439/572 |
| 6,783,394 | B1 | 8/2004 | Holliday | |
| 6,786,767 | B1 | 9/2004 | Fuks et al. | 439/578 |
| 6,790,081 | B2 | 9/2004 | Burris et al. | |
| 6,793,528 | B2 | 9/2004 | Lin et al. | |
| 6,802,738 | B1 | 10/2004 | Henningsen | |
| 6,805,581 | B2 | 10/2004 | Chen | 439/578 |
| 6,805,583 | B2 | 10/2004 | Holliday et al. | |
| 6,805,584 | B1 | 10/2004 | Chen | |
| 6,808,415 | B1 | 10/2004 | Montena | |
| 6,817,272 | B2 | 11/2004 | Holland | |
| 6,817,869 | B1 | 11/2004 | Derenthal | 439/578 |
| 6,817,896 | B2 | 11/2004 | Derenthal | |
| 6,817,897 | B2 | 11/2004 | Chee | |
| 6,827,608 | B2 | 12/2004 | Hall et al. | |
| 6,830,479 | B2 | 12/2004 | Holliday | |
| 6,848,115 | B2 | 1/2005 | Sugiura et al. | |
| 6,848,939 | B2 | 2/2005 | Stirling | 439/578 |
| 6,848,940 | B2 | 2/2005 | Montena | 439/584 |
| 6,848,941 | B2 | 2/2005 | Wlos et al. | 439/585 |
| 6,884,113 | B1 | 4/2005 | Montena | 439/578 |
| 6,884,115 | B2 | 4/2005 | Malloy | 439/584 |
| 6,887,102 | B1 | 5/2005 | Burris et al. | |
| 6,929,265 | B2 | 8/2005 | Holland et al. | 277/622 |
| 6,929,508 | B1 | 8/2005 | Holland | 439/579 |
| 6,935,866 | B2 | 8/2005 | Kerekes et al. | |
| 6,939,169 | B2 | 9/2005 | Islam et al. | 439/578 |
| 6,942,516 | B2 | 9/2005 | Shimoyama et al. | |
| 6,942,520 | B2 | 9/2005 | Barlian et al. | |
| 6,945,805 | B1 | 9/2005 | Bollinger | |
| 6,948,976 | B2 | 9/2005 | Goodwin et al. | 439/578 |
| 6,953,371 | B2 | 10/2005 | Baker et al. | |
| 6,955,563 | B1 | 10/2005 | Croan | |
| 6,971,912 | B2 | 12/2005 | Montena et al. | 439/578 |
| 7,008,263 | B2 | 3/2006 | Holland | |
| 7,018,216 | B1 | 3/2006 | Clark et al. | |

(56) References Cited

U.S. PATENT DOCUMENTS

| | | | | |
|---|---|---|---|---|
| 7,018,235 | B1 | 3/2006 | Burris et al. | |
| 7,029,326 | B2 | 4/2006 | Montena | 439/585 |
| 7,063,565 | B2 | 6/2006 | Ward | |
| 7,070,447 | B1 | 7/2006 | Montena | 439/578 |
| 7,077,697 | B2 | 7/2006 | Kooiman | |
| 7,086,897 | B2 | 8/2006 | Montena | 439/578 |
| 7,090,525 | B1 | 8/2006 | Morana | |
| 7,094,114 | B2 | 8/2006 | Kurimoto | |
| 7,097,499 | B1 | 8/2006 | Purdy | 439/578 |
| 7,102,868 | B2 | 9/2006 | Montena | 361/119 |
| 7,112,078 | B2 | 9/2006 | Czikora | |
| 7,112,093 | B1 | 9/2006 | Holland | |
| 7,114,990 | B2 | 10/2006 | Bence et al. | 439/583 |
| 7,118,285 | B2 | 10/2006 | Fenwick et al. | |
| 7,118,382 | B2 | 10/2006 | Kerekes et al. | |
| 7,118,416 | B2 | 10/2006 | Montena et al. | 439/584 |
| 7,125,283 | B1 | 10/2006 | Lin | 439/578 |
| 7,128,604 | B2 | 10/2006 | Hall | |
| 7,131,867 | B1 | 11/2006 | Foster et al. | 439/578 |
| 7,131,868 | B2 | 11/2006 | Montena | 439/578 |
| 7,140,645 | B2 | 11/2006 | Cronley | |
| 7,144,271 | B1 | 12/2006 | Burris et al. | 439/578 |
| 7,147,509 | B1 | 12/2006 | Burris et al. | 439/578 |
| 7,156,696 | B1 | 1/2007 | Montena | 439/584 |
| 7,161,785 | B2 | 1/2007 | Chawgo | 361/119 |
| 7,165,974 | B2 | 1/2007 | Kooiman | |
| 7,173,121 | B2 | 2/2007 | Fang | |
| 7,179,121 | B1 | 2/2007 | Burris et al. | 439/578 |
| 7,179,122 | B2 | 2/2007 | Holliday | |
| 7,182,639 | B2 | 2/2007 | Burris | |
| 7,189,114 | B1 | 3/2007 | Burris et al. | |
| 7,192,308 | B2 | 3/2007 | Rodrigues et al. | |
| 7,229,303 | B2 | 6/2007 | Vermoesen et al. | 439/271 |
| 7,238,047 | B2 | 7/2007 | Saetele et al. | |
| 7,252,536 | B2 | 8/2007 | Lazaro, Jr. et al. | |
| 7,252,546 | B1 | 8/2007 | Holland | 439/584 |
| 7,255,598 | B2 | 8/2007 | Montena et al. | 439/578 |
| 7,261,594 | B2 | 8/2007 | Kodama et al. | |
| 7,264,502 | B2 | 9/2007 | Holland | |
| 7,278,882 | B1 | 10/2007 | Li | |
| 7,288,002 | B2 | 10/2007 | Rodrigues et al. | |
| 7,291,033 | B2 | 11/2007 | Hu | |
| 7,299,550 | B2 | 11/2007 | Montena | |
| 7,318,609 | B2 | 1/2008 | Naito et al. | |
| 7,322,846 | B2 | 1/2008 | Camelio | |
| 7,322,851 | B2 | 1/2008 | Brookmire | |
| 7,329,139 | B2 | 2/2008 | Benham | |
| 7,335,058 | B1 | 2/2008 | Burris et al. | |
| 7,347,129 | B1 | 3/2008 | Youtsey | 81/467 |
| 7,347,726 | B2 | 3/2008 | Wlos | |
| 7,347,727 | B2 | 3/2008 | Wlos et al. | |
| 7,347,729 | B2 | 3/2008 | Thomas et al. | |
| 7,351,088 | B1 | 4/2008 | Qu | |
| 7,357,641 | B2 | 4/2008 | Kerekes et al. | |
| 7,364,462 | B2 | 4/2008 | Holland | |
| 7,371,112 | B2 | 5/2008 | Burris et al. | |
| 7,375,533 | B2 | 5/2008 | Gale | 324/538 |
| 7,387,524 | B2 | 6/2008 | Cheng | |
| 7,393,245 | B2 | 7/2008 | Palinkas et al. | 439/620.03 |
| 7,396,249 | B2 | 7/2008 | Kauffman | |
| 7,404,737 | B1 | 7/2008 | Youtsey | 439/578 |
| 7,410,389 | B2 | 8/2008 | Holliday | |
| 7,416,415 | B2 | 8/2008 | Hart et al. | |
| 7,438,327 | B2 | 10/2008 | Auray et al. | |
| 7,452,239 | B2 | 11/2008 | Montena | 439/620.03 |
| 7,455,550 | B1 | 11/2008 | Sykes | 439/584 |
| 7,458,850 | B1 | 12/2008 | Burris et al. | |
| 7,462,068 | B2 | 12/2008 | Amidon | 439/578 |
| 7,467,980 | B2 | 12/2008 | Chiu | |
| 7,476,127 | B1 | 1/2009 | Wei | 439/583 |
| 7,478,475 | B2 | 1/2009 | Hall | |
| 7,479,033 | B1 | 1/2009 | Sykes et al. | 439/578 |
| 7,479,035 | B2 | 1/2009 | Bence et al. | 439/583 |
| 7,484,988 | B2 | 2/2009 | Ma et al. | |
| 7,484,997 | B2 | 2/2009 | Hofling | |
| 7,488,210 | B1 | 2/2009 | Burris et al. | 439/578 |
| 7,494,355 | B2 | 2/2009 | Hughes et al. | 439/181 |
| 7,497,729 | B1 | 3/2009 | Wei | 439/578 |
| 7,500,868 | B2 | 3/2009 | Holland et al. | |
| 7,500,873 | B1 | 3/2009 | Hart | |
| 7,507,116 | B2 | 3/2009 | Laerke et al. | |
| 7,507,117 | B2 | 3/2009 | Amidon | 439/584 |
| 7,513,788 | B2 | 4/2009 | Camelio | |
| 7,544,094 | B1 | 6/2009 | Paglia et al. | 439/585 |
| 7,563,133 | B2 | 7/2009 | Stein | |
| 7,566,236 | B2 | 7/2009 | Malloy et al. | 439/321 |
| 7,568,945 | B2 | 8/2009 | Chee et al. | |
| 7,578,693 | B2 | 8/2009 | Yoshida et al. | |
| 7,588,454 | B2 | 9/2009 | Nakata et al. | |
| 7,607,942 | B1 | 10/2009 | Van Swearingen | 439/578 |
| 7,625,227 | B1 | 12/2009 | Henderson et al. | |
| 7,632,143 | B1 | 12/2009 | Islam | |
| 7,635,283 | B1 | 12/2009 | Islam | 439/583 |
| 7,651,376 | B2 | 1/2010 | Schreier | |
| 7,674,132 | B1 | 3/2010 | Chen | 439/578 |
| 7,682,177 | B2 | 3/2010 | Berthet | |
| 7,682,188 | B1 | 3/2010 | Berthet | 439/321 |
| 7,714,229 | B2 | 5/2010 | Burris et al. | |
| 7,727,011 | B2 | 6/2010 | Montena et al. | 439/578 |
| 7,749,021 | B2 | 7/2010 | Brodeur | |
| 7,753,705 | B2 | 7/2010 | Montena | 439/277 |
| 7,753,710 | B2 | 7/2010 | George | |
| 7,753,727 | B1 | 7/2010 | Islam et al. | 439/583 |
| 7,758,370 | B1 | 7/2010 | Flaherty | |
| 7,794,275 | B2 | 9/2010 | Rodrigues | 439/584 |
| 7,806,714 | B2 | 10/2010 | Williams et al. | 439/352 |
| 7,806,725 | B1 | 10/2010 | Chen | 439/578 |
| 7,811,133 | B2 | 10/2010 | Gray | 439/607.41 |
| D626,920 | S | 11/2010 | Purdy et al. | |
| 7,824,216 | B2 | 11/2010 | Purdy | 439/578 |
| 7,828,595 | B2 | 11/2010 | Mathews | 439/578 |
| 7,830,154 | B2 | 11/2010 | Gale | 324/538 |
| 7,833,053 | B2 | 11/2010 | Mathews | 439/578 |
| 7,845,976 | B2 | 12/2010 | Mathews | 439/578 |
| 7,845,978 | B1 | 12/2010 | Chen | 439/578 |
| 7,845,980 | B1 | 12/2010 | Amidon | |
| 7,850,472 | B2 | 12/2010 | Friedrich et al. | |
| 7,850,487 | B1 | 12/2010 | Wei | 439/578 |
| 7,857,661 | B1 | 12/2010 | Islam | 439/584 |
| 7,874,870 | B1 | 1/2011 | Chen | |
| 7,887,354 | B2 | 2/2011 | Holliday | 439/321 |
| 7,892,004 | B2 | 2/2011 | Hertzler et al. | 439/312 |
| 7,892,005 | B2 | 2/2011 | Haube | |
| 7,892,024 | B1 | 2/2011 | Chen | 439/578 |
| 7,914,326 | B2 | 3/2011 | Sutter | |
| 7,918,687 | B2 | 4/2011 | Paynter et al. | |
| 7,927,135 | B1 | 4/2011 | Wlos | 439/584 |
| 7,934,955 | B1 | 5/2011 | Hsia | 439/578 |
| 7,942,695 | B1 | 5/2011 | Lu | |
| 7,950,958 | B2 | 5/2011 | Mathews | 439/578 |
| 7,955,126 | B2 | 6/2011 | Bence et al. | 439/583 |
| 7,972,158 | B2 | 7/2011 | Wild et al. | 439/257 |
| 7,972,176 | B2 | 7/2011 | Burris et al. | |
| 7,982,005 | B2 | 7/2011 | Ames et al. | 530/350 |
| 8,011,955 | B1 | 9/2011 | Lu | |
| 8,025,518 | B2 | 9/2011 | Burris et al. | |
| 8,029,315 | B2 | 10/2011 | Purdy et al. | 439/578 |
| 8,029,316 | B2 * | 10/2011 | Snyder et al. | 439/578 |
| 8,062,044 | B2 | 11/2011 | Montena et al. | 439/277 |
| 8,062,063 | B2 | 11/2011 | Malloy et al. | 439/578 |
| 8,070,504 | B2 | 12/2011 | Amidon et al. | |
| 8,075,337 | B2 | 12/2011 | Malloy et al. | 439/578 |
| 8,075,338 | B1 | 12/2011 | Montena | |
| 8,079,860 | B1 | 12/2011 | Zraik | |
| 8,087,954 | B2 | 1/2012 | Fuchs | |
| 8,113,875 | B2 | 2/2012 | Malloy et al. | 439/578 |
| 8,157,587 | B2 | 4/2012 | Paynter et al. | |
| 8,157,588 | B1 | 4/2012 | Rodrigues et al. | |
| 8,167,636 | B1 | 5/2012 | Montena | |
| 8,172,612 | B2 | 5/2012 | Bence et al. | 439/578 |
| 8,177,572 | B2 | 5/2012 | Feye-Hohmann | |
| 8,192,237 | B2 | 6/2012 | Purdy et al. | 439/792 |
| 8,206,172 | B2 | 6/2012 | Katagiri et al. | |
| D662,893 | S | 7/2012 | Haberek et al. | |

(56) References Cited

U.S. PATENT DOCUMENTS

| | | | | |
|---|---|---|---|---|
| 8,231,412 | B2 | 7/2012 | Paglia et al. | 439/607.17 |
| 8,262,408 | B1 * | 9/2012 | Kelly | 439/578 |
| 8,272,893 | B2 | 9/2012 | Burris et al. | |
| 8,287,320 | B2 | 10/2012 | Purdy et al. | 439/792 |
| 8,313,345 | B2 | 11/2012 | Purdy | 439/578 |
| 8,313,353 | B2 | 11/2012 | Purdy et al. | 439/792 |
| 8,317,539 | B2 | 11/2012 | Stein | |
| 8,323,053 | B2 | 12/2012 | Montena | |
| 8,323,058 | B2 | 12/2012 | Flaherty et al. | |
| 8,323,060 | B2 | 12/2012 | Purdy et al. | 439/792 |
| 8,337,229 | B2 | 12/2012 | Montena | |
| 8,376,769 | B2 | 2/2013 | Holland et al. | 439/322 |
| D678,844 | S | 3/2013 | Haberek | |
| 8,398,421 | B2 | 3/2013 | Haberek et al. | |
| 8,449,326 | B2 | 5/2013 | Holland et al. | |
| 8,469,739 | B2 | 6/2013 | Rodrigues et al. | |
| D686,164 | S | 7/2013 | Haberek et al. | |
| D686,576 | S | 7/2013 | Haberek et al. | |
| 8,480,430 | B2 | 7/2013 | Ehret et al. | |
| 8,506,325 | B2 | 8/2013 | Malloy et al. | |
| 8,517,763 | B2 | 8/2013 | Burris et al. | |
| 8,517,764 | B2 | 8/2013 | Wei et al. | |
| 8,529,279 | B2 | 9/2013 | Montena | |
| 8,550,835 | B2 | 10/2013 | Montena | |
| 8,568,163 | B2 | 10/2013 | Burris et al. | |
| 8,568,165 | B2 | 10/2013 | Wei et al. | |
| 8,591,244 | B2 | 11/2013 | Thomas et al. | |
| 8,597,050 | B2 | 12/2013 | Flaherty et al. | |
| 8,636,529 | B2 | 1/2014 | Stein | |
| 8,647,136 | B2 | 2/2014 | Purdy et al. | |
| 8,690,603 | B2 | 4/2014 | Bence et al. | |
| 8,721,365 | B2 | 5/2014 | Holland | |
| 8,727,800 | B2 | 5/2014 | Holland et al. | |
| 8,777,658 | B2 | 7/2014 | Holland et al. | |
| 8,777,661 | B2 | 7/2014 | Holland et al. | |
| 8,858,251 | B2 | 10/2014 | Montena | |
| 8,888,526 | B2 | 11/2014 | Burris | |
| 8,920,192 | B2 | 12/2014 | Montena | |
| 2001/0034143 | A1 | 10/2001 | Annequin | |
| 2001/0046802 | A1 | 11/2001 | Perry et al. | |
| 2001/0051448 | A1 | 12/2001 | Gonzale | |
| 2002/0013088 | A1 | 1/2002 | Rodriguez et al. | 439/578 |
| 2002/0019161 | A1 | 2/2002 | Finke et al. | |
| 2002/0038720 | A1 | 4/2002 | Kai et al. | 174/125.1 |
| 2002/0146935 | A1 | 10/2002 | Wong | 439/583 |
| 2003/0110977 | A1 | 6/2003 | Batlaw | 106/31.13 |
| 2003/0119358 | A1 | 6/2003 | Henningsen | 439/578 |
| 2003/0139081 | A1 | 7/2003 | Hall et al. | |
| 2003/0194890 | A1 | 10/2003 | Ferderer et al. | |
| 2003/0214370 | A1 | 11/2003 | Allison et al. | |
| 2003/0224657 | A1 | 12/2003 | Malloy | 439/578 |
| 2004/0031144 | A1 | 2/2004 | Holland | |
| 2004/0077215 | A1 | 4/2004 | Palinkas et al. | 439/578 |
| 2004/0102089 | A1 | 5/2004 | Chee | 439/578 |
| 2004/0157499 | A1 | 8/2004 | Nania et al. | |
| 2004/0194585 | A1 * | 10/2004 | Clark | 81/124.2 |
| 2004/0209516 | A1 | 10/2004 | Burris et al. | 439/587 |
| 2004/0219833 | A1 | 11/2004 | Burris et al. | 439/578 |
| 2004/0229504 | A1 | 11/2004 | Liu | 439/578 |
| 2005/0042919 | A1 | 2/2005 | Montena | 439/578 |
| 2005/0079762 | A1 | 4/2005 | Hsia | 439/578 |
| 2005/0159045 | A1 | 7/2005 | Huang | 439/584 |
| 2005/0170692 | A1 | 8/2005 | Montena | 439/578 |
| 2005/0181652 | A1 | 8/2005 | Montena et al. | 439/271 |
| 2005/0181668 | A1 | 8/2005 | Montena et al. | 439/578 |
| 2005/0208827 | A1 | 9/2005 | Burris et al. | 439/578 |
| 2005/0233636 | A1 | 10/2005 | Rodrigues et al. | 439/578 |
| 2006/0014425 | A1 | 1/2006 | Montena | |
| 2006/0099853 | A1 | 5/2006 | Sattele et al. | 439/578 |
| 2006/0110977 | A1 | 5/2006 | Matthews | 439/578 |
| 2006/0154519 | A1 | 7/2006 | Montena | 439/578 |
| 2006/0166552 | A1 | 7/2006 | Bence et al. | 439/578 |
| 2006/0178046 | A1 | 8/2006 | Tusini | 439/578 |
| 2006/0194465 | A1 | 8/2006 | Czikora | |
| 2006/0223355 | A1 | 10/2006 | Hirschmann | |
| 2006/0246774 | A1 | 11/2006 | Buck | |
| 2006/0258209 | A1 | 11/2006 | Hall | |
| 2006/0276079 | A1 | 12/2006 | Chen | |
| 2007/0004276 | A1 | 1/2007 | Stein | |
| 2007/0026734 | A1 | 2/2007 | Bence et al. | 439/583 |
| 2007/0049113 | A1 | 3/2007 | Rodrigues et al. | 439/578 |
| 2007/0054535 | A1 | 3/2007 | Hall et al. | |
| 2007/0059968 | A1 | 3/2007 | Ohtaka et al. | |
| 2007/0082533 | A1 | 4/2007 | Currier et al. | |
| 2007/0087613 | A1 | 4/2007 | Schumacher et al. | |
| 2007/0123101 | A1 | 5/2007 | Palinkas | 439/579 |
| 2007/0155232 | A1 | 7/2007 | Burris et al. | 439/578 |
| 2007/0173100 | A1 | 7/2007 | Benham | |
| 2007/0175027 | A1 | 8/2007 | Khemakhem et al. | 29/857 |
| 2007/0232117 | A1 | 10/2007 | Singer | |
| 2007/0243759 | A1 * | 10/2007 | Rodrigues et al. | 439/578 |
| 2007/0243762 | A1 | 10/2007 | Burke et al. | 439/589 |
| 2007/0287328 | A1 | 12/2007 | Hart et al. | |
| 2008/0032556 | A1 | 2/2008 | Schreier | |
| 2008/0102696 | A1 * | 5/2008 | Montena | 439/578 |
| 2008/0171466 | A1 | 7/2008 | Buck et al. | 439/578 |
| 2008/0200066 | A1 | 8/2008 | Hofling | |
| 2008/0200068 | A1 | 8/2008 | Aguirre | |
| 2008/0214040 | A1 | 9/2008 | Holterhoff et al. | |
| 2008/0289470 | A1 | 11/2008 | Aston | 83/698.41 |
| 2009/0029590 | A1 | 1/2009 | Sykes et al. | 439/585 |
| 2009/0098770 | A1 | 4/2009 | Bence et al. | 439/583 |
| 2009/0104801 | A1 | 4/2009 | Silva | |
| 2009/0163075 | A1 | 6/2009 | Blew et al. | 439/583 |
| 2009/0186505 | A1 | 7/2009 | Mathews | |
| 2009/0264003 | A1 | 10/2009 | Hertzler et al. | |
| 2009/0305560 | A1 | 12/2009 | Chen | 439/584 |
| 2010/0007441 | A1 | 1/2010 | Yagisawa et al. | |
| 2010/0022125 | A1 | 1/2010 | Burris et al. | |
| 2010/0028563 | A1 | 2/2010 | Ota | |
| 2010/0055978 | A1 | 3/2010 | Montena | 439/583 |
| 2010/0080563 | A1 | 4/2010 | DiFonzo et al. | |
| 2010/0081321 | A1 | 4/2010 | Malloy et al. | 439/578 |
| 2010/0081322 | A1 | 4/2010 | Malloy et al. | 439/578 |
| 2010/0087071 | A1 | 4/2010 | DiFonzo et al. | |
| 2010/0105246 | A1 | 4/2010 | Burris et al. | 439/578 |
| 2010/0124839 | A1 | 5/2010 | Montena | 439/489 |
| 2010/0130060 | A1 | 5/2010 | Islam | 439/584 |
| 2010/0178799 | A1 | 7/2010 | Lee | |
| 2010/0216339 | A1 | 8/2010 | Burris et al. | 439/578 |
| 2010/0233901 | A1 | 9/2010 | Wild et al. | 439/578 |
| 2010/0233902 | A1 | 9/2010 | Youtsey | 439/578 |
| 2010/0233903 | A1 | 9/2010 | Islam | 439/578 |
| 2010/0255719 | A1 | 10/2010 | Purdy | |
| 2010/0255721 | A1 | 10/2010 | Purdy et al. | 439/583 |
| 2010/0279548 | A1 | 11/2010 | Montena et al. | 439/620.04 |
| 2010/0297871 | A1 | 11/2010 | Haube | 439/489 |
| 2010/0297875 | A1 | 11/2010 | Purdy et al. | 439/578 |
| 2010/0304579 | A1 | 12/2010 | Kisling | |
| 2010/0323541 | A1 | 12/2010 | Amidon et al. | |
| 2011/0021072 | A1 | 1/2011 | Purdy | 439/578 |
| 2011/0021075 | A1 | 1/2011 | Orner et al. | 439/585 |
| 2011/0027039 | A1 | 2/2011 | Blair | 411/149 |
| 2011/0039448 | A1 | 2/2011 | Stein | |
| 2011/0053413 | A1 | 3/2011 | Mathews | 439/578 |
| 2011/0074388 | A1 | 3/2011 | Bowman | 324/76.38 |
| 2011/0080158 | A1 | 4/2011 | Lawrence et al. | 324/76.12 |
| 2011/0111623 | A1 | 5/2011 | Burris et al. | 439/578 |
| 2011/0111626 | A1 | 5/2011 | Paglia et al. | |
| 2011/0117774 | A1 | 5/2011 | Malloy et al. | 439/578 |
| 2011/0143567 | A1 | 6/2011 | Purdy et al. | 439/277 |
| 2011/0151714 | A1 | 6/2011 | Flaherty et al. | |
| 2011/0230089 | A1 | 9/2011 | Amidon et al. | 439/578 |
| 2011/0230091 | A1 | 9/2011 | Krenceski et al. | 439/578 |
| 2011/0237123 | A1 | 9/2011 | Burris et al. | |
| 2011/0237124 | A1 | 9/2011 | Flaherty et al. | |
| 2011/0250789 | A1 | 10/2011 | Burris et al. | |
| 2011/0318958 | A1 | 12/2011 | Burris et al. | 439/578 |
| 2012/0021642 | A1 | 1/2012 | Zraik | |
| 2012/0040537 | A1 | 2/2012 | Burris | 439/11 |
| 2012/0045933 | A1 | 2/2012 | Youtsey | 439/578 |
| 2012/0064768 | A1 | 3/2012 | Islam et al. | 439/585 |
| 2012/0094530 | A1 | 4/2012 | Montena | 439/578 |
| 2012/0100751 | A1 | 4/2012 | Montena | 439/578 |

(56) References Cited

U.S. PATENT DOCUMENTS

| | | | | |
|---|---|---|---|---|
| 2012/0108098 | A1 | 5/2012 | Burris et al. | |
| 2012/0122329 | A1 | 5/2012 | Montena | 439/271 |
| 2012/0129387 | A1 | 5/2012 | Holland et al. | 439/578 |
| 2012/0171894 | A1 | 7/2012 | Malloy et al. | 439/578 |
| 2012/0178289 | A1 | 7/2012 | Holliday | |
| 2012/0202378 | A1 | 8/2012 | Krenceski et al. | 439/578 |
| 2012/0222302 | A1 | 9/2012 | Purdy et al. | 29/876 |
| 2012/0225581 | A1 | 9/2012 | Amidon et al. | 439/584 |
| 2012/0315788 | A1 | 12/2012 | Montena | |
| 2013/0065433 | A1 | 3/2013 | Burris | 439/578 |
| 2013/0072057 | A1 | 3/2013 | Burris | 439/578 |
| 2013/0178096 | A1 | 7/2013 | Matzen | |
| 2014/0106612 | A1 | 4/2014 | Burris | |
| 2014/0120766 | A1 | 5/2014 | Meister et al. | |
| 2014/0148051 | A1 | 5/2014 | Bence et al. | |
| 2014/0106613 | A1 | 7/2014 | Burris | |
| 2014/0322968 | A1 | 10/2014 | Burris | |

FOREIGN PATENT DOCUMENTS

| | | | | |
|---|---|---|---|---|
| CN | 201149937 | Y | 11/2008 | |
| CN | 201178228 | Y | 1/2009 | |
| CN | 201904508 | | 7/2011 | |
| DE | 47931 | C | 10/1888 | |
| DE | 102289 | C | 7/1897 | |
| DE | 1117687 | | 11/1961 | |
| DE | 1191880 | | 4/1965 | |
| DE | 1515398 | B1 | 4/1970 | |
| DE | 2225764 | A1 | 12/1972 | |
| DE | 2221936 | A1 | 11/1973 | |
| DE | 2261973 | A1 | 6/1974 | |
| DE | 3211008 | A1 | 10/1983 | |
| DE | 9001608.4 | U1 | 5/1990 | |
| DE | 4439852 | C2 | 5/1996 | |
| DE | 19957518 | A1 | 9/2001 | |
| DE | 19957518 | C2 | 9/2001 | |
| EP | 0072104 | | 2/1983 | |
| EP | 0116157 | A1 | 8/1984 | |
| EP | 0167738 | A2 | 1/1986 | |
| EP | 0265276 | B1 | 4/1988 | |
| EP | 0428424 | A2 | 5/1991 | |
| EP | 1191268 | B1 | 3/2002 | |
| EP | 1501159 | A1 | 1/2005 | |
| EP | 1548898 | B1 | 6/2005 | |
| EP | 1603200 | | 12/2005 | |
| EP | 1701410 | A2 | 9/2006 | |
| EP | 2051340 | | 4/2009 | |
| FR | 2232846 | A1 | 6/1973 | |
| FR | 2234680 | A2 | 6/1973 | |
| FR | 2312918 | A1 | 5/1975 | |
| FR | 2462798 | A1 | 2/1981 | |
| FR | 2494508 | A1 | 5/1982 | |
| GB | 589697 | A | 6/1947 | |
| GB | 1087228 | A | 10/1967 | |
| GB | 1270846 | A | 4/1972 | |
| GB | 1332888 | | 10/1973 | |
| GB | 1401373 | A | 7/1975 | |
| GB | 1421215 | | 1/1976 | |
| GB | 2019665 | A | 10/1979 | |
| GB | 2079549 | A | 1/1982 | |
| GB | 2252677 | A | 8/1992 | |
| GB | 2264201 | A | 8/1993 | |
| GB | 2331634 | A | 5/1999 | |
| GB | 2448595 | | 10/2008 | |
| GB | 2450248 | | 12/2008 | |
| JP | 3280369 | A | 12/1992 | |
| JP | 2002-15823 | A | 1/2002 | |
| JP | 4503793 | B | 7/2010 | |
| KR | 100622526 | | 9/2006 | |
| TW | 427044 | | 3/2001 | |
| WO | WO 87/00351 | A1 | 1/1987 | |
| WO | WO 01/86756 | A1 | 11/2001 | |
| WO | WO 02/069457 | A1 | 9/2002 | |
| WO | WO 2004/013883 | A2 | 2/2004 | |
| WO | WO 2006/081141 | A1 | 8/2006 | |
| WO | 2007062845 | | 6/2007 | |
| WO | 2009/066705 | A1 | 5/2009 | H01R 24/02 |
| WO | 2010135181 | | 11/2010 | |
| WO | 2011057033 | | 5/2011 | |
| WO | 2012162431 | | 5/2011 | |
| WO | 2011128665 | | 10/2011 | |
| WO | 2011128666 | | 10/2011 | |
| WO | 2013126629 | | 8/2013 | |

OTHER PUBLICATIONS

The American Society of Engineers, ASME B 18.21.1-1999, Lock Washers (Inch Series).

US Office Action, U.S. Appl. No. 10/997,218; Jul. 31, 2006, pp. 1-10.

Office Action dated Jun. 12, 2014 pertaining to U.S. Appl. No. 13/795,737.

Office Action dated Aug. 25, 2014 pertaining to U.S. Appl. No. 13/605,481.

Election/Restrictions Requirement dated Jul. 31, 2014 pertaining to U.S. Appl. No. 13/652,969.

Office Action dated Aug. 29, 2014 pertaining to U.S. Appl. No. 13/827,522.

Election/Restrictions Requirement dated Jun. 20, 2014 pertaining to U.S. Appl. No. 13/795,780.

Corning Gilbert 2004 OEM Coaxial Products Catalog, Quick Disconnects, 2 pages.

Digicon AVL Connector. Arris Group Inc. [online] 3 pages. Retrieved from the Internet: <URL: http://www.arrisi.com/special/digiconAVL.asp.

Society of Cable Telecommunications Engineers, Engineering Committee, Interface Practices Subcommittee; American National Standard; ANSI/SCTE 01 2006; Specification for "F" Port, Female, Outdoor. Published Jan. 2006. 9 pages.

U.S. Appl. No. 90/012,300 filed Jun. 29, 2012, regarding U.S. Pat. No. 8,172,612 filed May 27, 2011 (Bence et al.).

U.S. Appl. No. 90/012,749 filed Dec. 21, 2012, regarding U.S. Pat. No. 7,114,990, filed Jan. 25, 2005 (Bence et al.).

U.S. Appl. No. 90/012,835 filed Apr. 11, 2013, regarding U.S. Pat. No. 8,172,612 filed May 27, 2011 (Bence et al.).

Notice of Allowance (Mail Date Mar. 20, 2012) for U.S. Appl. No. 13/117,843.

Search Report dated Jun. 6, 2014 pertaining to International application No. PCT/US2014/023374.

Search Report dated Apr. 9, 2014 pertaining to International application No. PCT/US2014/015934.

Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.

PPC. "Next Generation Compression Connectors," pp. 1-6, Retrieved from http://www.tessco.com/yts/partnearnanufacturerlist/vendors/ppc/pdf/ppcdigital spread.pdf.

Patent Cooperation Treaty, International Search Report for PCT/US2013/070497, Feb. 11, 2014, 3 pgs.

Patent Cooperation Treaty, International Search Report for PCT/US2013/064515, 10 pgs.

Patent Cooperation Treaty, International Search Report for PCT/US2013/064512, Jan. 21, 2014, 11 pgs.

Huber+Suhner AG, RF Connector Guide: Understanding connector technology, 2007, Retrieved from http://www.ie.itcr.ac.cr/marin/lic/e14515/Huber+Suener_RF_Connector_Guide.pdf.

Slade, Paul G,. Electrical Contacts: Principles and Applications, 1999, Retrieved from http://books.google.com/books (table of contents only).

U.S. Appl. No. 95/002,400 filed Sep. 15, 2012, regarding U.S. Pat. No. 8,192,237 filed Feb. 23, 2011 (Purdy et al.).

U.S. Appl. No. 90/013,068 filed Nov. 27, 2013, regarding U.S. Pat. No. 6,558,194 filed Jul. 21, 2000 (Montena).

U.S. Appl. No. 90/013,069 filed Nov. 27, 2013, regarding U.S. Pat. No. 6,848,940 filed Jan. 21, 2003 (Montena).

U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).

(56) References Cited

OTHER PUBLICATIONS

U.S. Inter Partes Review Case No. 2013-00343 filed Jun. 10, 2013, regarding U.S. Pat. No. 8,313,353 filed Apr. 30, 2012, claims 1-6 (Purdy et al.).
U.S. Inter Partes Review Case No. 2013-00340 filed Jun. 10, 2013, regarding U.S. Pat. No. 8,323,060 filed Jun. 14, claims 1-9 (Purdy et al.).
U.S. Inter Partes Review Case No. 2013-00347 filed Jun. 10, 2013, regarding U.S. Pat. No. 8,287,320 filed Dec. 8, 2009, claims 9, 17, 32 (Purdy et al.).
U.S. Inter Partes Review Case No. 2013-00345 filed Jun. 10, 2013, regarding U.S. Pat. No. 8,313,353 filed Apr. 30, 2012, claims 7-27 (Purdy et al.).
U.S. Inter Partes Review Case No. 2013-00342 filed Jun. 10, 2013, regarding U.S. Pat. No. 8,323,060 filed Jun. 14, 2012, claims 10-25 (Purdy et al.).
U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Office Action dated Sep. 19, 2014 pertaining to U.S. Appl. No. 13/795,780.
Office Action dated Oct. 6, 2014 pertaining to U.S. Appl. No. 13/732,679.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.

* cited by examiner

COAXIAL CONNECTOR WITH INHIBITED INGRESS AND IMPROVED GROUNDING

CROSS-REFERENCE TO RELATED APPLICATIONS

This application claims the benefit of, and priority to U.S. Provisional Patent Application No. 61/323,597 filed on Apr. 13, 2010 entitled, "Coaxial Connector With Inhibited Ingress and Improved Grounding", the content of which is relied upon and incorporated herein by reference in its entirety.

BACKGROUND

1. Field

The disclosure relates generally to coaxial cable connectors, and particularly to coaxial cable connectors capable of connecting a coaxial cable to a terminal.

2. Technical Background

With the advent of digital signal in CATV systems, a rise in customer complaints due to poor picture quality in the form of signal interference resulting in what is known as "tiling" and the like has occurred. Complaints of this nature result in CATV system operators having to send a technician to address the issue. Frequently, it is reported by the technician that the cause of the problem is a loose F connector fitting. Type F connector fittings may be loose for many reasons, sometimes they are not properly tightened due to installation rules of system operators that prohibit the use of wrenches in-doors on customer equipment. Other times, a homeowner may relocate equipment after the technician departs and may not adequately secure the F connectors. Additionally, some claim that F connector couplers loosen due to vibration and/or heat and cold cycles.

In any event, an improperly installed connector may result in poor signal transfer because there are discontinuities along the electrical path between the devices, resulting in a leak of radio frequency ("RF") signal. That leak may be in the form of signal egress where the RF energy radiates out of the connector/cable arrangement. Alternately, an RF leak may be in the form of signal ingress where RF energy from an external source or sources may enter the connector/cable arrangement causing a signal to noise ratio problem resulting in an unacceptable picture.

F connectors typically rely on intimate contact between the F male connector interface and the F female connector interface. If for some reason, the connector interfaces are allowed to pull apart from each other, such as in the case of a loose F male coupler, an interface "gap" may result. This gap can be a point of an RF leak as previously described. Typically, in such situations where the F male coupler is loose, the configuration allows for two distinct signal ingress paths. One path is found from the "back" of the F male coupler between the coupler bore and connector body. When the coupler is loosened, the connector body is permitted to move about, creating gaps that were previously secured when the connection was tight. Typically, these gaps allow a signal path along a relatively straightforward line. The other path is found at the "front" of the F male coupler along the spiral path of the interconnecting thread system. In the loose condition, tolerances in the thread system allow signal ingress because the flanks of the treads are not intimately engaged enough to provide adequate shielding.

To at least partially address the signal ingress and grounding issues, a number of approaches have been introduced, including U.S. Pat. No. 7,114,990 (Bence, et al.); U.S. Pat. No. 7,479,035 (Bence, et al.); U.S. Pat. No. 6,716,062 (Palinkas, et al.) and US Patent application 2008/0102696 (Montena). In addition, other approaches have been introduced to at least partially address the issue of loosening Type F couplers, including a lock-washer design produced by Phoenix Communications Technologies International (PCT) known at the DRS and TRS connectors. However, there is a continuing need for improved connector designs that address theses issues simultaneously.

SUMMARY

One embodiment of the disclosure relates to a coaxial connector for coupling an end of a coaxial cable to a terminal. The coaxial connector includes a hollow body having a front end, a rear end, and an internal surface extending between the front end and the rear end, the internal surface defining a longitudinal opening. The coaxial connector also includes a tubular post disposed at least partially within the longitudinal opening of the hollow body. The tubular post includes a front end, a rear end, a tubular shank adjacent to the rear end, and a flange adjacent to the front end, wherein the flange has an outer diameter that is larger than the outer diameter of the tubular shank. In addition, the coaxial connector includes a coupling nut having a front end, and a rear end, and a radially inward directed collar with a circular aperture formed therein. The circular aperture has a diameter that is less than the outer diameter of the flange of the tubular post and a front end facing surface of the radially inward directed collar rotationally engages a rear end facing surface of the flange of the tubular post. The coaxial connector further includes a sealing member disposed between a rear end facing surface of the radially inward directed collar and a front end facing surface of the hollow body. The sealing member is axially compressed by the rear end facing surface of the radially inward directed collar and the front end facing surface of the hollow body.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION OF THE PREFERRED EMBODIMENTS

Figure 1:
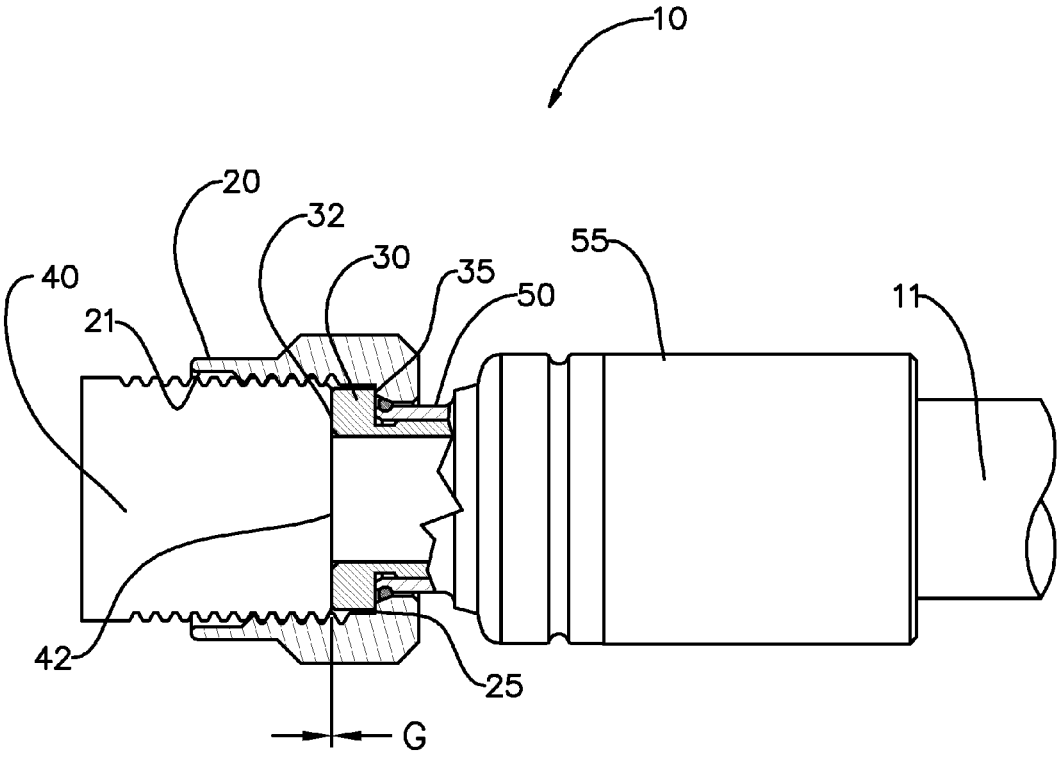
FIG. 1 PRIOR ART
FIG. 1 illustrates a partial cross sectional view of a prior art connector in a state of proper engagement with a terminal or port.

Reference will now be made in detail to embodiments of coaxial connectors, examples of which are illustrated in the accompanying drawings. Whenever possible, the same reference numerals will be used throughout the drawings to refer to the same or like parts.

Referring to FIG. 1, a prior art coaxial connector 10 has a coupling nut 20, a post 30, a body 50, and a compression ring 55. The coaxial connector 10 is an axial-compression type coaxial connector and the connection of the coaxial connector 10 to a coaxial 11 cable is known in the art. The coaxial connector 10 is illustrated in FIG. 1 in its attached, compressed state. When properly tightened to port 40, the gap "G" between post face 32 and port face 42 is completely closed. In other words, post face 32 and port face 42 are in intimate contact.

Figure 2:
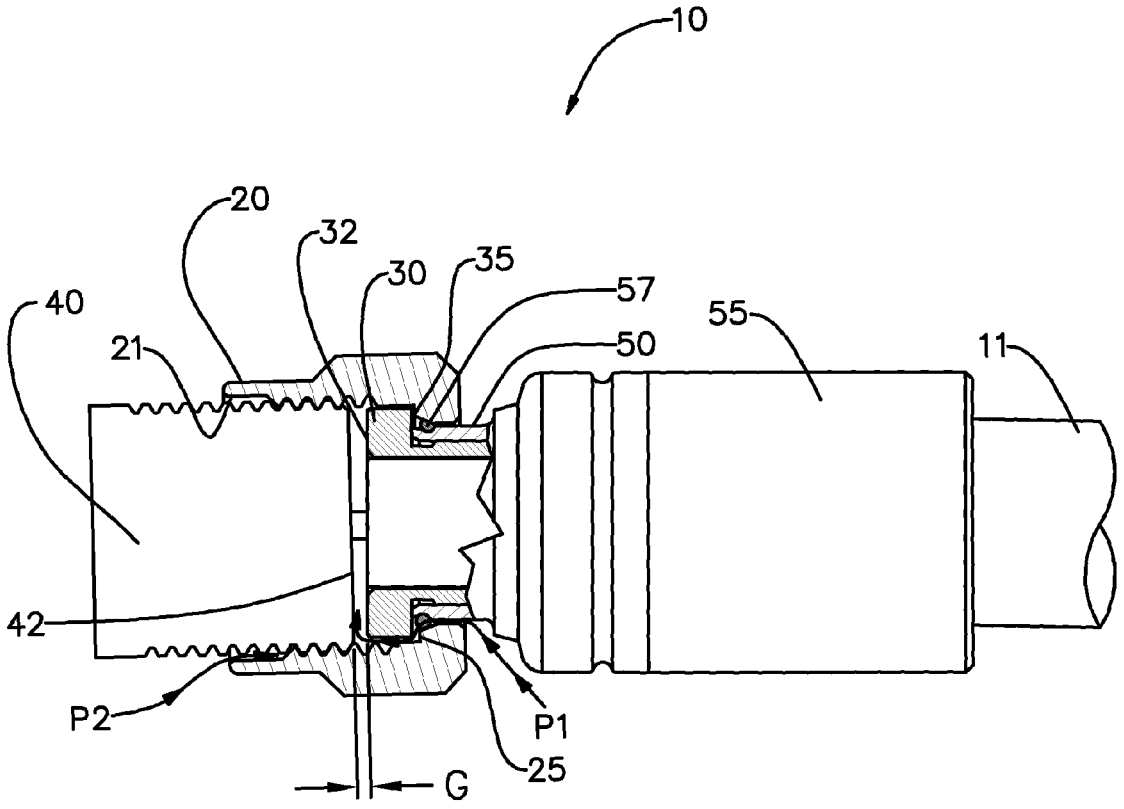
FIG. 2 PRIOR ART
FIG. 2 illustrates a partial cross sectional view of the connector illustrated in FIG. 1 in a state of improper engagement (otherwise known as "loose") with a terminal or port.

FIG. 2 illustrates coaxial connector 10 and port 40 of FIG. 1, wherein coupling nut 20 of connector 10 is not fully tightened thereby allowing post face 32 and port face 42 to be spaced apart at gap "G". The resultant gap "G" and clearances between internal features of coupler 20 and body 50 result in a relatively unobstructed ingress path "P1". RF (Radio Frequency) signal ingress travels along this path into the connector interface allowing undesirable electrical interference. The RF ingress path is unimpeded by non-conductive materials such as o-ring 57. A secondary ingress path "P2" is created when the internal threaded portion of coupler 20 is not loaded against external threaded portion of port 40. Said secondary ingress path "P2" is abetted by relatively large mechanical clearances between pilot bore 21 of coupler 20 and external surfaces of port 42. Body 50 and post 30 of connector 10 are permitted to angle away from a fully axial alignment with port 42 causing body 50 and post 30 to have limited, incidental contact with coupler 20 resulting in an undependable, limited number of points electrical ground path.

Figure 3:
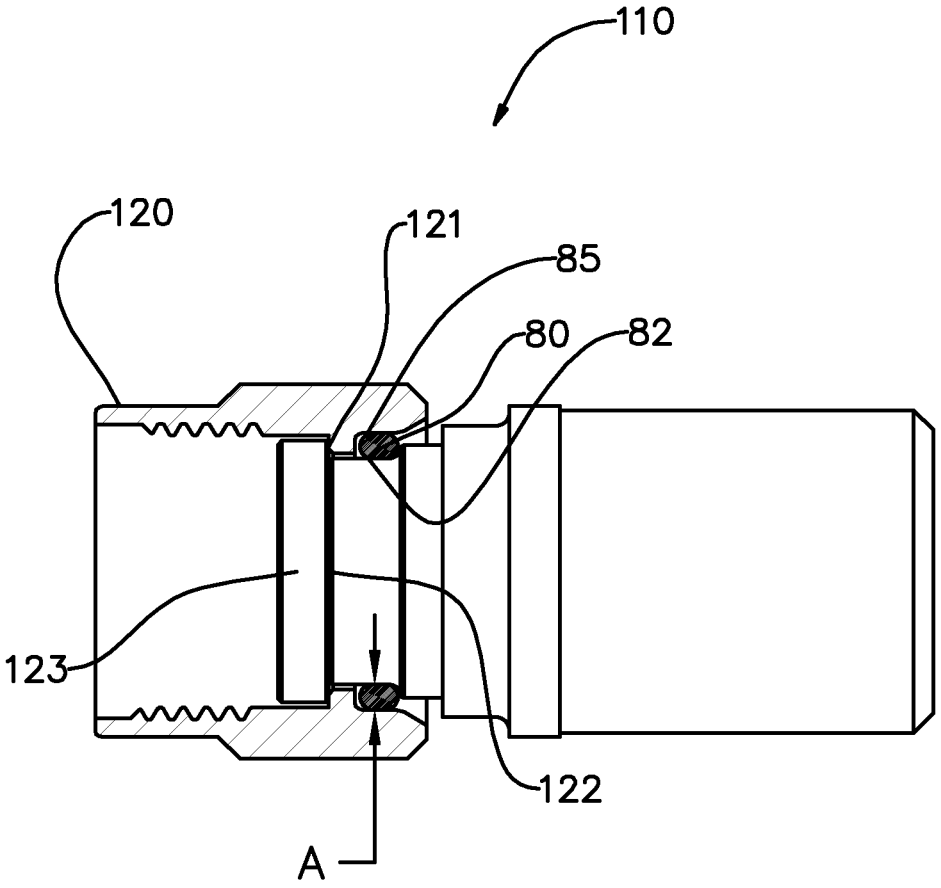
FIG. 3 PRIOR ART
FIG. 3 illustrates a partial cross sectional view of an alternative prior art connector in an uninstalled condition to illustrate o-ring utilization.

FIG. 3 illustrates a partial cross sectional view of an alternative prior art connector in an uninstalled condition illustrating o-ring utilization known and practiced in the art. O-ring 80 is compressed radially as illustrated at "A" (as opposed to being compressed axially) and is conventionally used as a moisture barrier. O-ring 80 is allowed axial clearance in order to ensure rotatability of coupler 120. This necessary clearance allows limited axial movement of coupler 120 and permits gapping between annular shoulder 121 of coupler 120 and annular shoulder 122 of post 123. Said gapping results in a situation for a relatively unobstructed ingress path as previously described.

Figure 4:
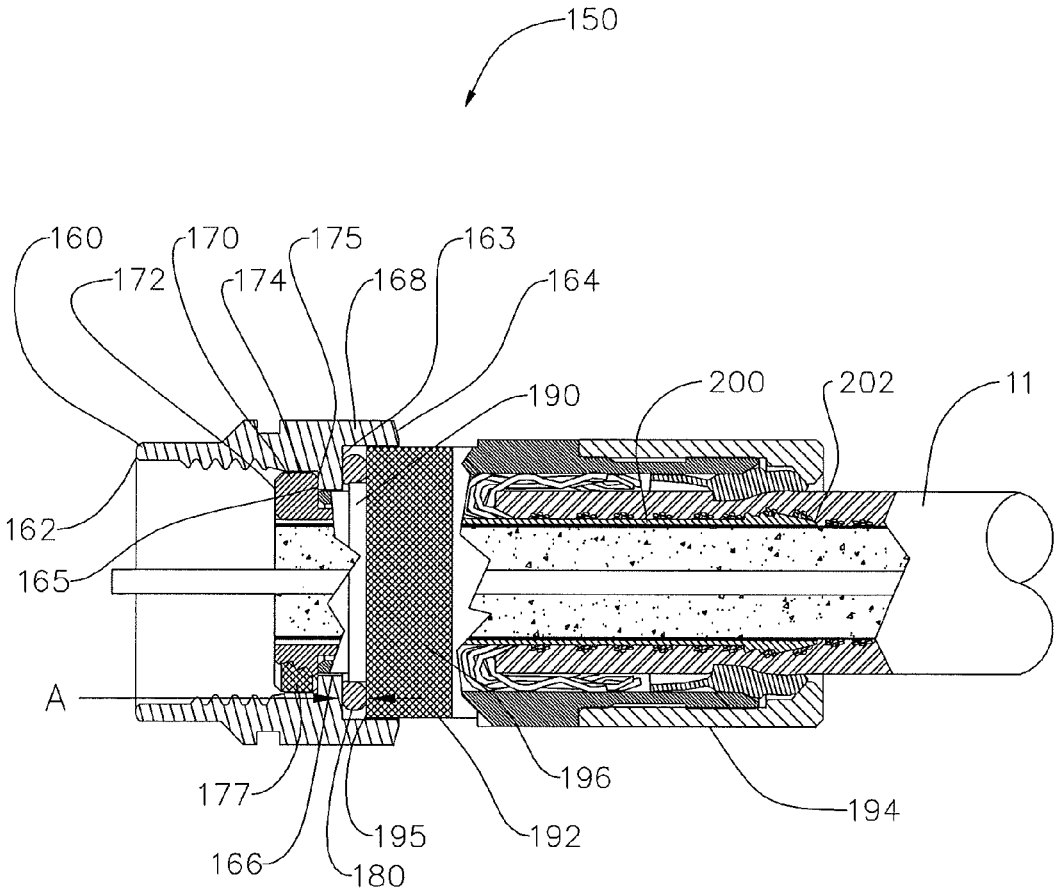
FIG. 4 illustrates a partial cross sectional view of a connector disclosed herein installed on a coaxial cable.

FIG. 4 illustrates a partial cross sectional view of a coaxial connector 150 as disclosed herein installed on a coaxial cable 11. Coaxial connector 150 includes coupling nut 160, post 170, sealing member 180, and body 190. Coupling nut 160, post 170, and body 190 are preferably made from a metallic material, such as brass and may optionally be plated with a conductive, corrosion-resistant material, such as nickel or tin.

Body 190 is preferably a hollow body having a front end 192, a rear end 194, and an internal surface (not shown) extending between the front and the rear end, wherein the internal surface defines a longitudinal opening.

Post 170 is preferably a tubular post disposed at least partially within the longitudinal opening of the body 190. Post 170 includes a front end 172 (including a forward facing post face), a rear end 202, a tubular shank 200 adjacent to the rear end 202, and a flange 174 adjacent to the front end 172, wherein the flange 174 has an outer diameter that is larger than the outer diameter of the tubular shank 200.

Coupling nut 160 includes a front end 162, and a rear end 164, and a radially inward directed collar 166 with a circular aperture formed therein. The circular aperture formed in the radially inward directed collar 166 has a diameter that is less than the outer diameter of the flange 174 of the post 170. A front end facing surface 165 of the radially inward directed collar 166 rotationally engages a rear end facing surface 175 of the flange 174 of the post 170.

Sealing member 180 is disposed between a rear end facing surface 163 of the radially inward directed collar 166 and a front end facing surface 195 of the body 190. Sealing member 180 is preferably an o-ring that is preferably made from an elastomer material, such as EPDM (Ethylene Propylene Diene Monomer).

As illustrated in FIG. 4, internal features of coupling nut 160 and body 190 define an annular space to house sealing member 180. This annular space is configured to pre-load sealing member 180 in an axial fashion indicated by "A" (in contrast to prior art utilization of the o-ring as illustrated in FIG. 3). Alternatively stated, sealing member 180 is axially compressed by the rear end facing surface 163 of the radially inward directed collar 166 and the front end facing surface 195 of the body 190. While the sealing member 180 performs an environmental sealing function, it now also serves to urge coupling nut 160 forward against post flange 174 to aid in electrical grounding. This, in conjunction with precision engineered fits between coupling nut 160, post 170, and body 190 restricts RF signal ingress paths from the rear of the connector coupler system. The increased convoluted RF ingress path "P" defined by the juxtaposition of coupling nut 160, post 170, and body 190 serves as a further barrier against RF signal ingress.

As further illustrated in FIG. 4, front end 192 and front end facing surface 195 of body 190 have a larger outer diameter than an outer diameter of the sealing member 180. In addition, to the rear of the radially inward directed collar 166, the coupling nut 160 includes a rearward extending annular portion 168 having a circular aperture formed therein. The circular aperture in the rearward extending annular portion 168 has a diameter that is greater than the circular aperture formed in the radially inward directed collar 166 and at least a portion of an inner surface of the rearward extending annular portion 168 contacts and circumferentially surrounds at least a portion of an outer surface of the body 190. Preferably, the circular aperture in the rearward extending annular portion 168 of the coupling nut 160 and the portion of the body 190 that is circumferentially surrounded by the rearward extending annular portion 168 of the coupling nut 160 each have an outer diameter that is greater than the outer diameter of the flange 174 of the post 170. Preferably, sealing member 180 also has an outer diameter that is greater than the outer diameter of the flange 174 of the post 170. Preferably, an outer diameter of the sealing member 180 does not contact the inner surface of the rearward extending annular portion 168 of the coupling nut 160 and an annular gap extends between the outer diameter of the sealing member 180 and the inner surface of the rearward extending annular portion 168 of the coupling nut 160. Annular gap allows for sealing member 180 to flex radially outwardly as it is being compressed axially.

In the embodiment illustrated in FIG. 4, sealing member 180 that is axially compressed by the rear end facing surface 163 of the radially inward directed collar 166 and the front end facing surface 195 of the body 190 does not contact post 170 (as opposed to the embodiment illustrated in FIG. 12 and described below).

Preferably, and as illustrated in FIG. 4, the portion of the body 190 that is circumferentially surrounded by the rearward extending annular portion 168 of the coupling nut 160 comprises a plurality of contact points 196 on its outer surface, wherein at least a portion of an outer surface of the contact points contact the inner surface of the rearward extending annular portion 168 of the coupling nut 160. For example, in a preferred embodiment, the contact points 196 comprise radially outwardly extending geometrically shaped projections, such as diamond-shaped, square-shaped, or circular-shaped projections. In a particularly preferred embodiment, and as illustrated in FIG. 4, the contact points 196 on the outer surface of body 190 comprise a knurled outer surface.

Figure 4A:
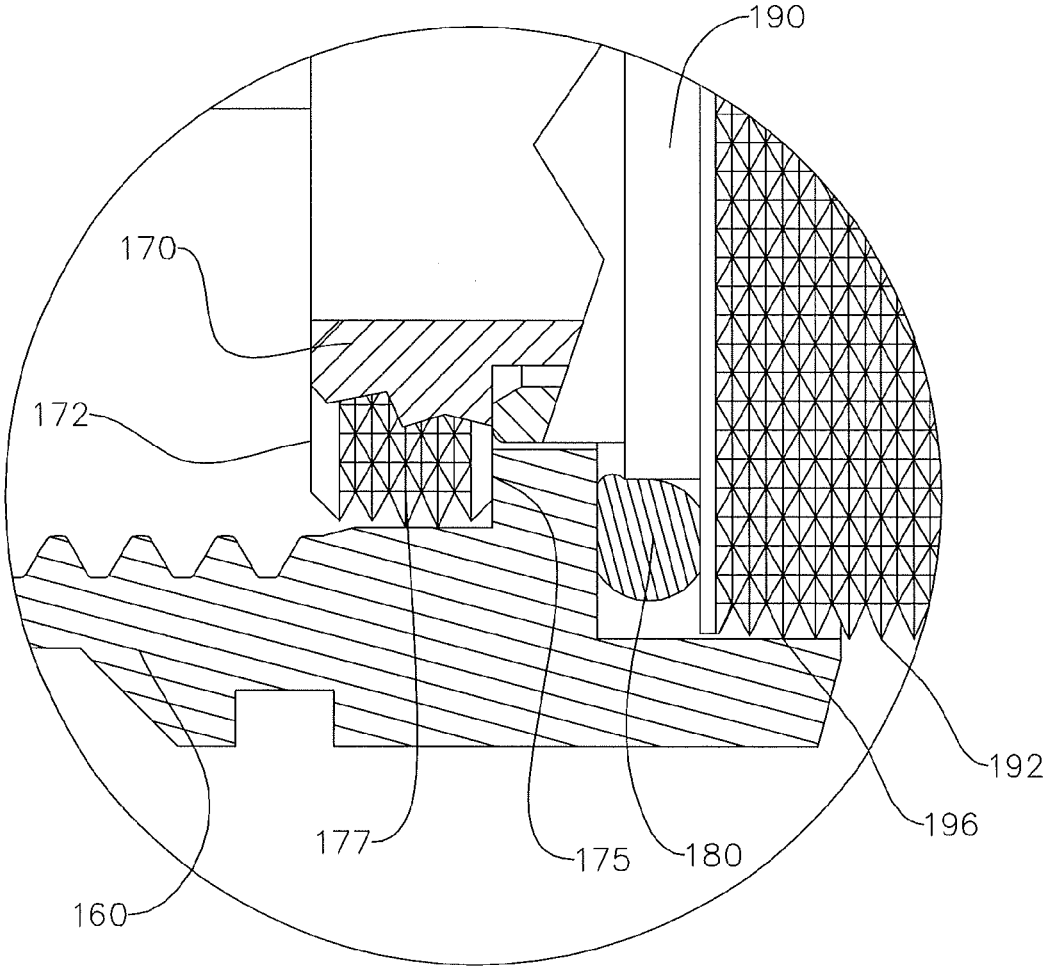
FIG. 4A illustrates an enlarged view of a portion of the connector illustrated in FIG. 4.

Post flange 174 also preferably comprises a plurality of contact points 177 on its outer surface, wherein at least a portion of an outer surface of the contact points contact an inner surface of the coupling nut 160. For example, in a preferred embodiment, the contact points 177 comprise radially outwardly extending geometrically shaped projections, such as diamond-shaped, square-shaped, or circular-shaped projections. In a particularly preferred embodiment, and as illustrated in FIG. 4, the contact points 177 on the outer surface of post flange 174 comprise a knurled outer surface. An enlarged view of these features is illustrated in FIG. 4A.

Formation of radially outwardly extending geometrically shaped projections as contact points about post flange 174 and body 190 by knurling or other means provides for increased contact pressure between the radial features of the connector components when the connector is in a loose condition (as illustrated, for example, in FIG. 6) further restricting RF signal ingress paths from the rear of the connector coupler system. Contact points 177 and/or 196 further serve to disrupt RF signal ingress by dispersing spurious RF signals in a manner roughly analogous to the use of LO technology (low observable technology) multi-planar surfaces employed on radar reflecting ships and aircraft. A further analogy to this approach is found in RF anechoic chamber technology.

Figure 5:
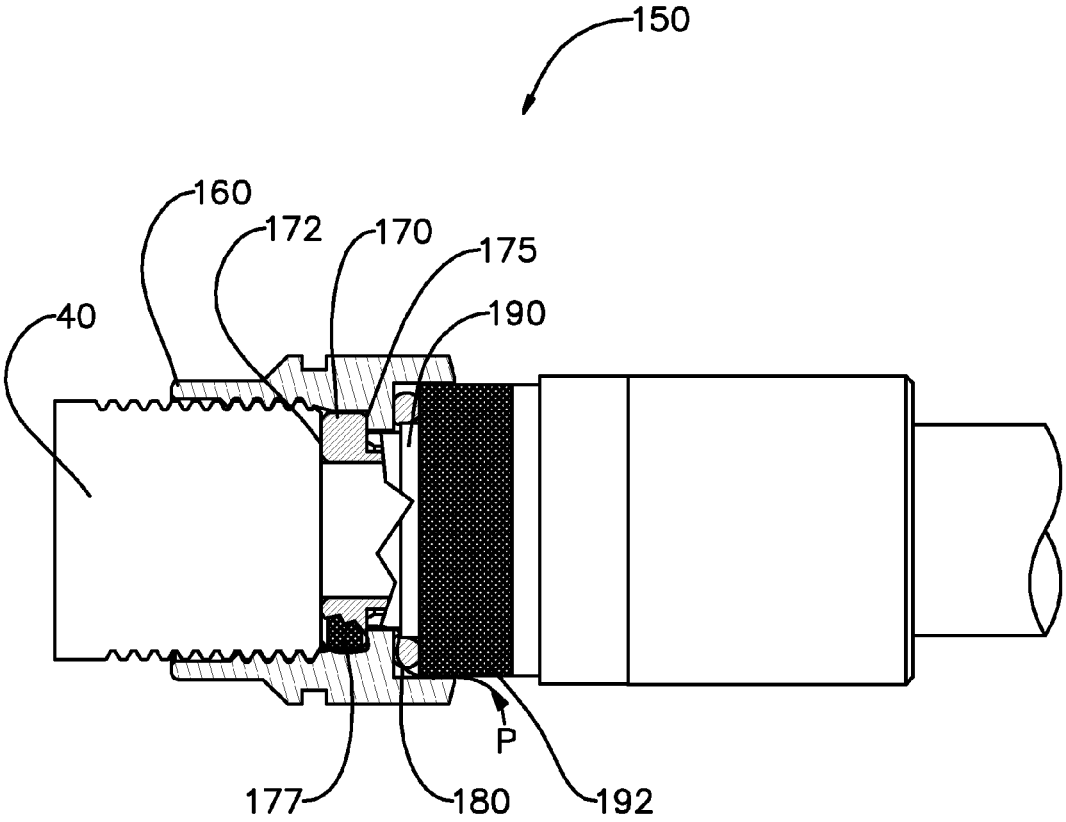
FIG. 5 illustrates a partial cross sectional view of the connector of FIG. 4 installed on a coaxial cable and fully secured to a terminal or port.

FIG. 5 illustrates a partial cross sectional view of the connector 150 illustrated in FIG. 4 installed on a coaxial cable and fully secured to a terminal or port 40. In this condition, all ingress paths are fully shielded as provided by application of proper torque to connector coupler 160.

Figure 6:
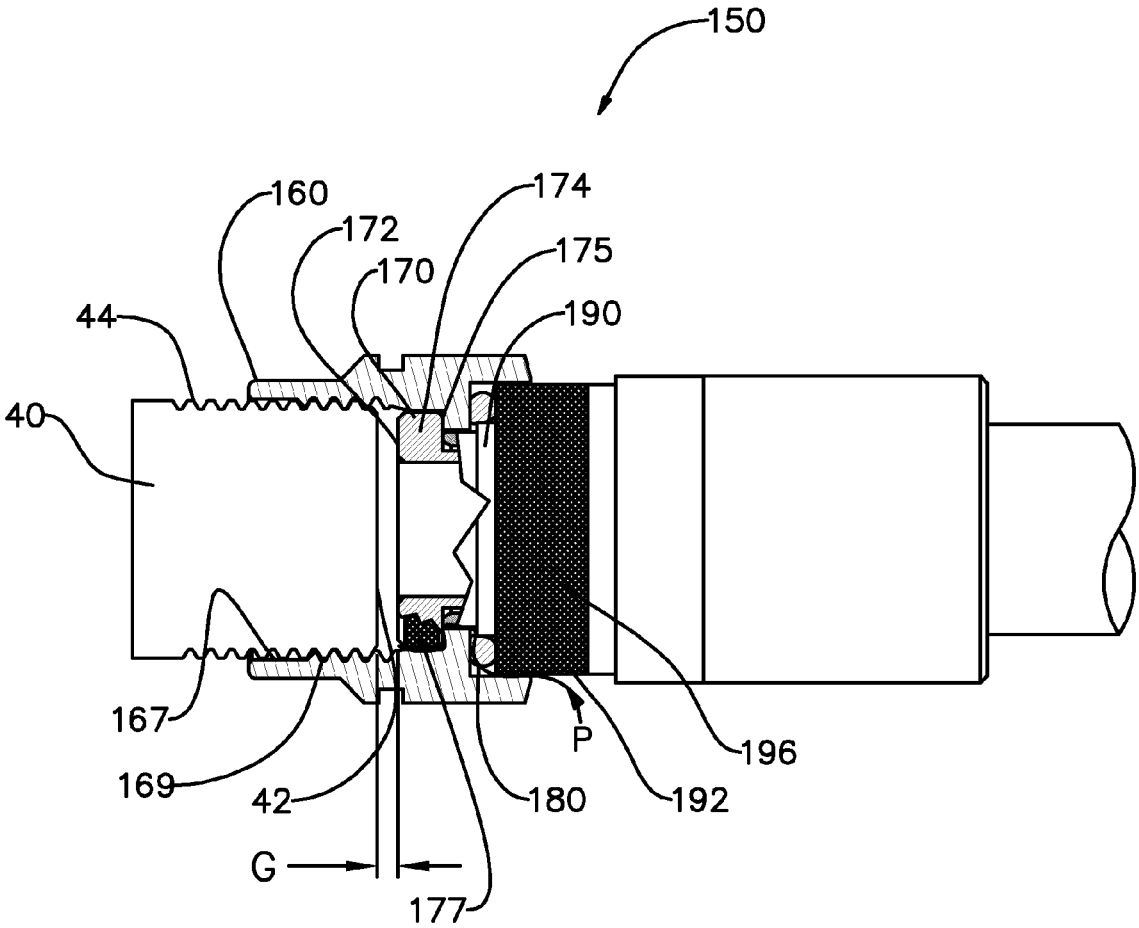
FIG. 6 illustrates a partial cross sectional view of the connector of FIG. 4 installed on a coaxial cable and partially secured to a terminal or port.

Turning to FIG. 6, the connector 150 illustrated in FIG. 4 and port 40 are illustrated where coupler 160 of connector 150 is not fully tightened thereby allowing post front end 172 (including post face) and port face 42 to be spaced apart at gap "G". As previously described, sealing member 180 performs not only an environmental sealing function but also serves to urge coupler 160 forward against post flange 174 to aid in electrical grounding. This, in conjunction with precision engineered fits between coupling nut 160, post 170 and body 190, restricts RF signal ingress paths from the rear of the connector coupler system. Forming of a plurality of contact points 177 about post 170 and a plurality of contact points 196 about body 190 by knurling or other means provides for increased contact pressure between the radial features of the connector components when the connector is in a loose condition as illustrated. The RF signal ingress path is further thwarted by the increased convolutions of the coupler/body/post configuration. This is especially useful in that RF signals tend to attenuate when presented by multiple, sharp changes in direction as provided herein. Additional thwarting of the RF ingress path on the port side of the coupler system is accomplished by restricting or choking the diametral clearances between inner bore of the front end of the coupling nut (or pilot bore 167) and major diameter port threads 44 of port 40. Further thwarting of the RF ingress path on the port side of the coupler system is accomplished by restricting or choking the diametral clearances between threads 169 of coupler 160 and minor diameter port threads 44 of port 40.

Figure 7:
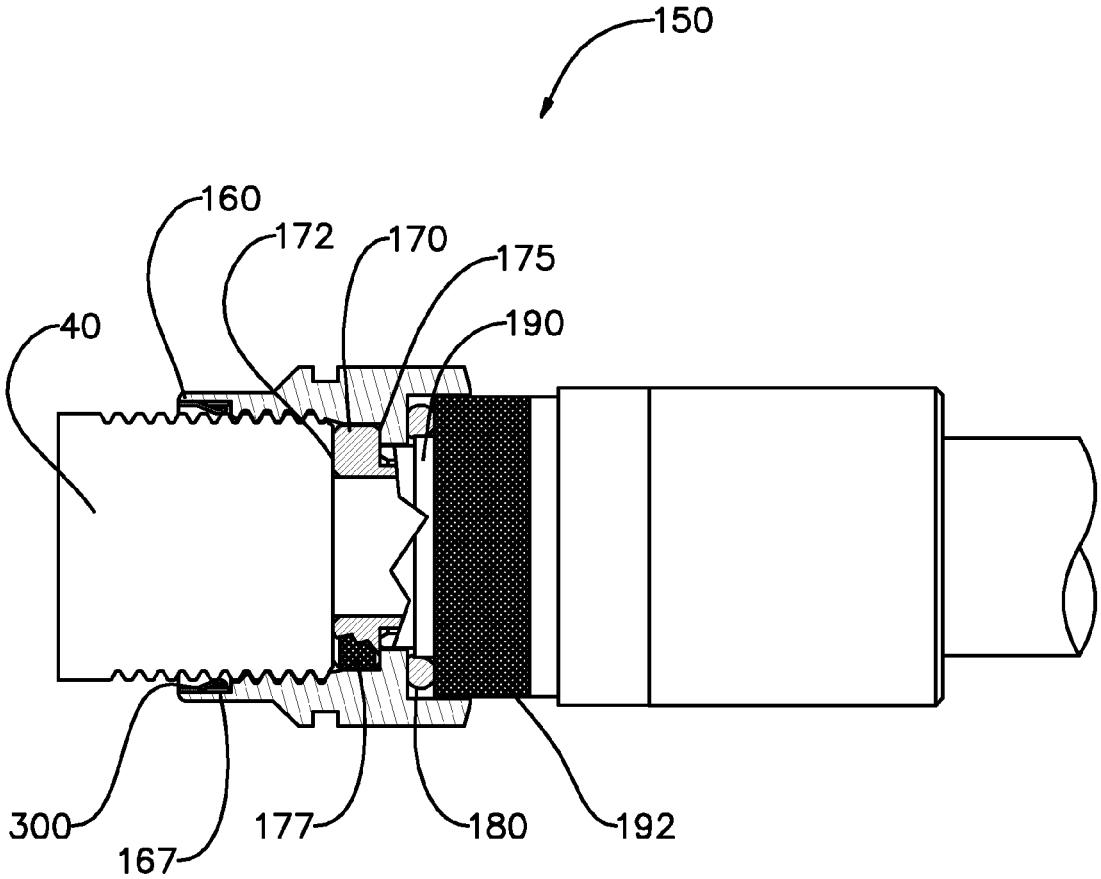
FIG. 7 illustrates a partial cross sectional view of an alternate embodiment of a connector comprising an alternate ground member and installed on a coaxial cable and fully secured to a terminal or port.

FIG. 7 illustrates a partial cross sectional view of an alternate embodiment of a connector 150 comprising an electrically conductive ground member 300 and installed on a coaxial cable 11 and fully secured to a terminal or port 40. Ground member 300 is preferably press-fitted into pilot bore 167 of coupling nut 160 and comprises a plurality of radially inwardly biased fingers that provide electrical and mechanical communication between coupling nut 160 and port 40. The ground member 300 is preferably made from a metallic material, such as beryllium copper and may optionally be plated with a conductive, corrosion-resistant material, such as tin. Alternatively, the ground member 300 may be a coil-type spring or alternatively, the ground member 300 may be an electrically conductive elastomer.

Figure 7A:
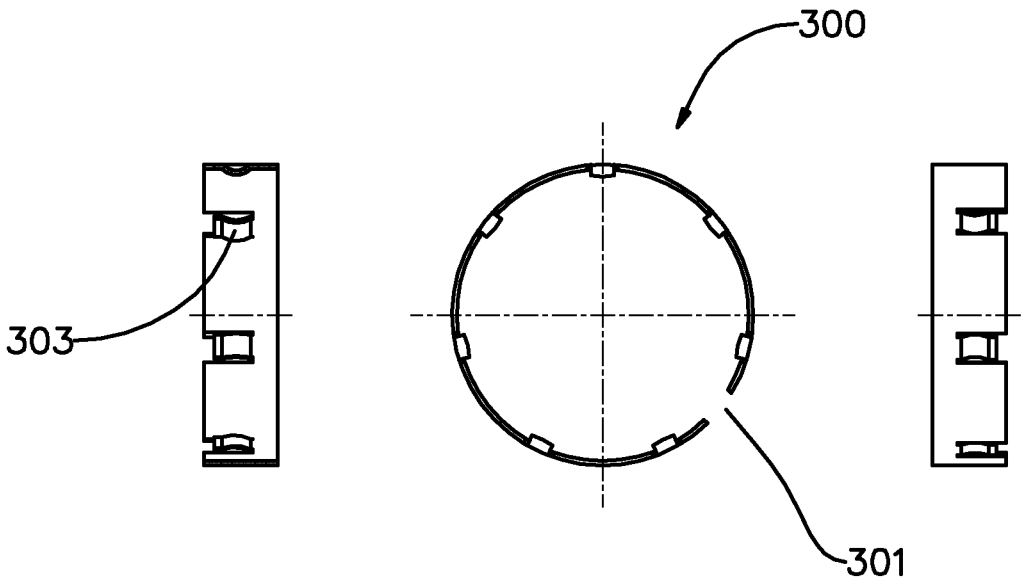
FIG. 7A illustrates side perspective and schematic end views of the alternate ground member shown on the connector illustrated in FIG. 7.

FIG. 7A illustrates side perspective and schematic end views of electrically conductive ground member 300 including radially inwardly biased fingers 303. Ground member 300 may, as shown in FIG. 7A, be c-shaped and include an optional radially extending slot 301. Alternatively, ground member 300 may entirely circumferentially surround pilot bore 167 (not shown).

Figure 8:
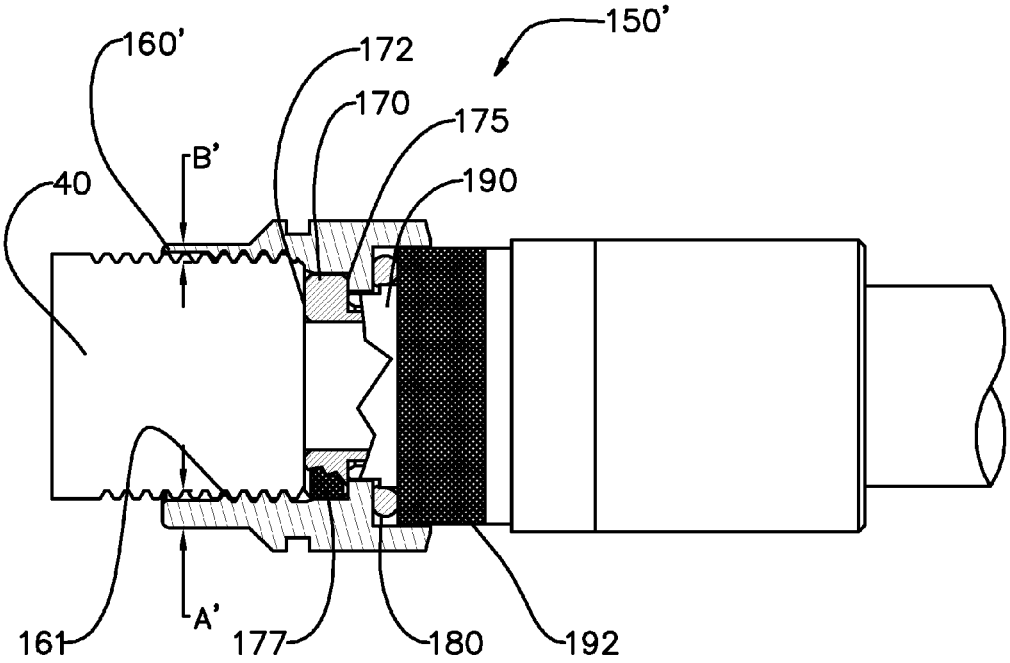
FIG. 8 illustrates a partial cross sectional view of an alternate embodiment of a connector comprising a coupling nut having an offset thread and installed on a coaxial cable and fully secured to a terminal or port.

FIG. 8 illustrates a partial cross sectional view of an alternate embodiment of a connector 150' comprising a coupling nut having an offset inner thread 161 and installed on a coaxial cable 11 and fully secured to a terminal or port 40.

Figure 8A:
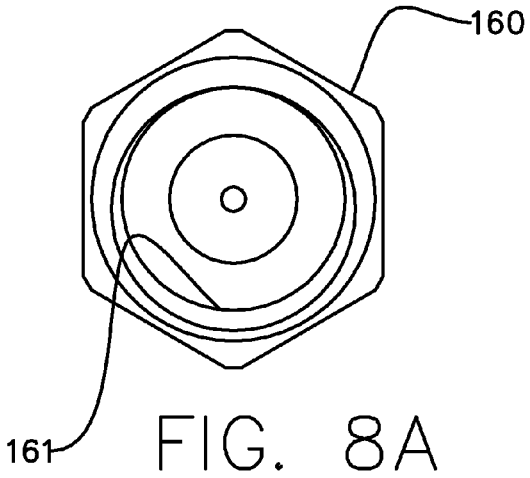
FIG. 8A illustrates a posterior schematic end view of the connector illustrated in FIG. 8.

Offset inner thread 161 is built into coupling nut 160' at an axis parallel to the center axis of coupling nut 160' but radially displaced from the center axis of coupling nut 160' such that the annular thickness of the coupling nut 160' between an inner surface and an outer surface varies circumferentially around the coupling nut 160'. For example, as illustrated in FIG. 8, the annular thickness of coupling nut 160' at A' is greater than the annular thickness of coupling nut 160' at B'. Preferably, the coupling nut 160' has an annular thickness that varies circumferentially around pilot bore 167 (see FIG. 8A, showing a posterior schematic end view of the connector illustrated in FIG. 8) such that the largest annular thickness of the coupling nut 160' around pilot bore 167 is at least 10%, more preferably at least 20%, and even more preferably at least 30% greater than the smallest annular thickness of coupling nut 160' around pilot bore 167. This has the effect of purposely misaligning connector 150' with port 40 forcing the cable center conductor (not shown) into a side-loaded condition. In this side-loaded condition, the copper coated steel center conductor is forced to act as a spring and thereby apply a force that enhances radial contact between threads of coupling nut 160' and thread 44 of port 40 ensuring an electrical ground path.

Figure 9:
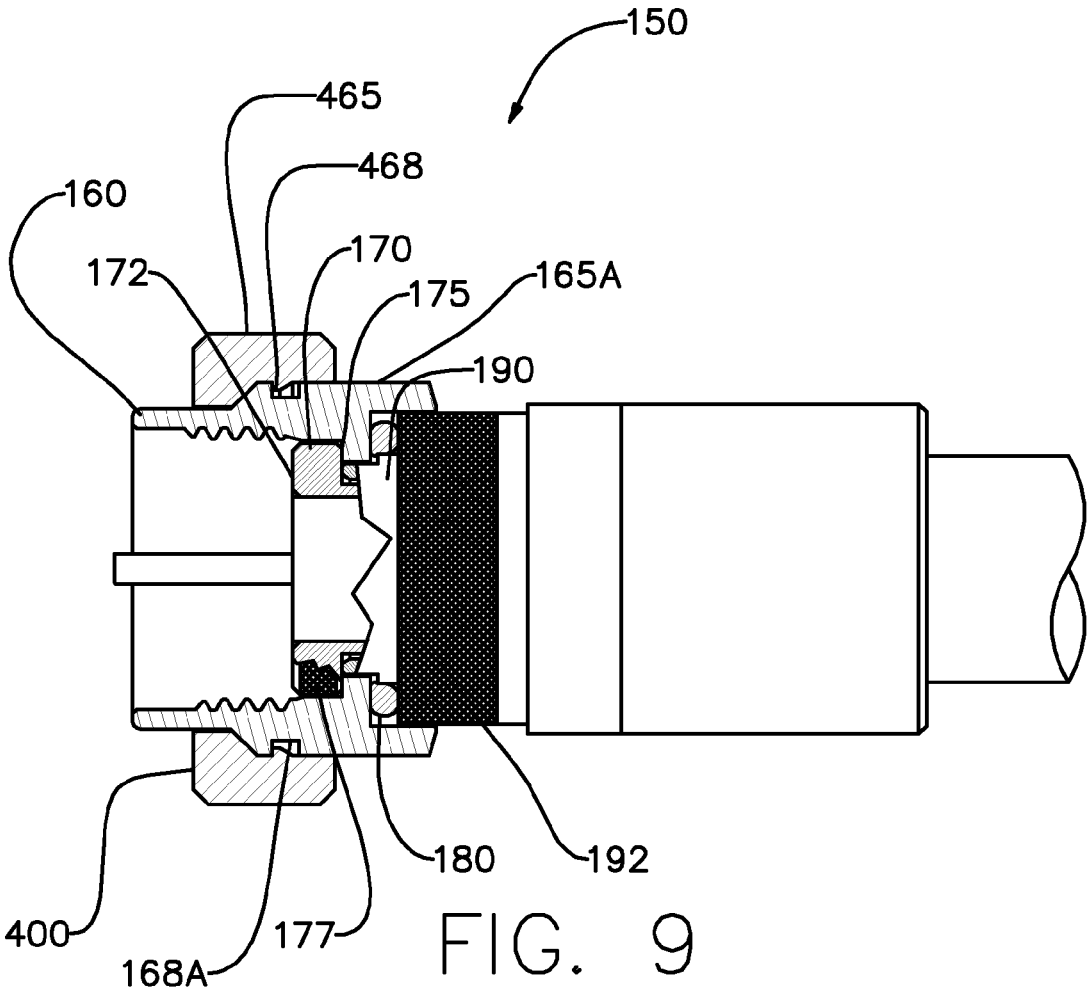
FIG. 9 illustrates a partial cross sectional view of the connector of FIG. 4 with an optional torque aid installed.
Figure 10:
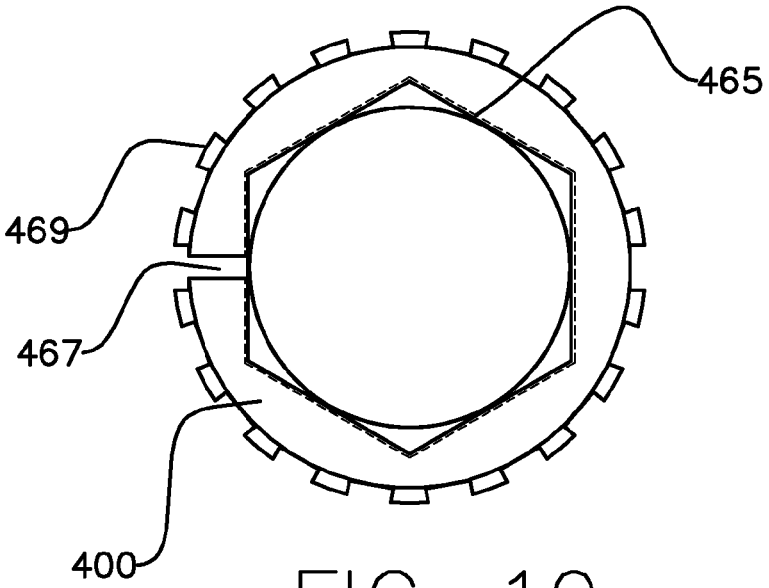
FIG. 10 illustrates a schematic end view of the optional torque aid illustrated in FIG. 9.

FIG. 9 illustrates a partial cross sectional view of connector 150 and an optional torque aid 400, wherein the torque aid 400 is installed on the connector 150 and is in contact with and circumferentially surrounds at least a portion of coupling nut 160. FIG. 10 illustrates a schematic end view of torque aid 400. Torque aid 400 is preferably made from a plastic material, such as acetal, and allows for the connector to be more adequately installed onto a port in limited accessibility situations by providing for improved finger grip on the coupler system. As shown in FIG. 10, torque aid 400 includes internal hex 465 which is configured to engage external hex 165A of coupling nut 160 while internal ridge 468 engage grooves 168A of coupling nut 160. Optional radially extending slot 467 allows torque aid 400 to snap over and onto coupling nut 160. A plurality of optional external gripping surfaces 469 provide for enhanced finger grip. Torque aid 400 is of further benefit in reducing the manufacturing cost of coupling nut 160 by eliminating the need to produce coupling nut 160 from a larger material stock size as seen in Corning Gilbert Connector GF-UR-6K currently produced for the industry.

Figure 11:
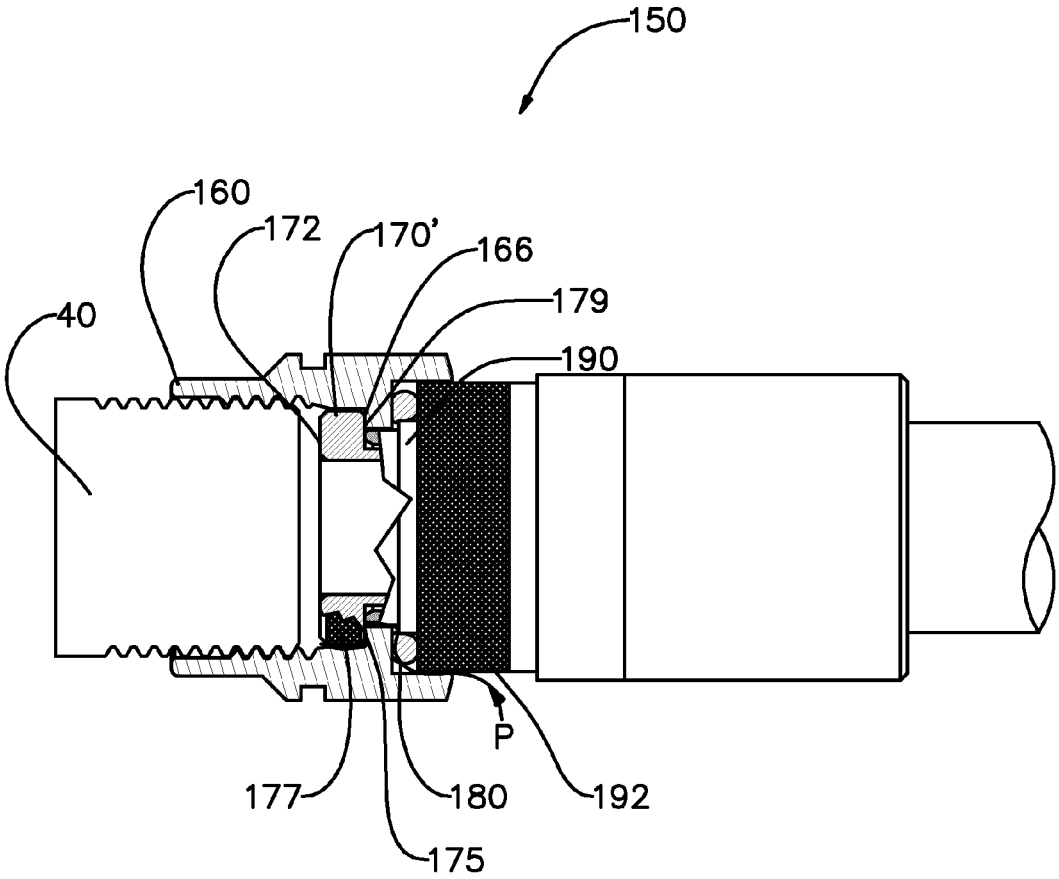
FIG. 11 illustrates a partial cross sectional view of an alternate embodiment of a connector comprising a modified post.
Figure 11A:
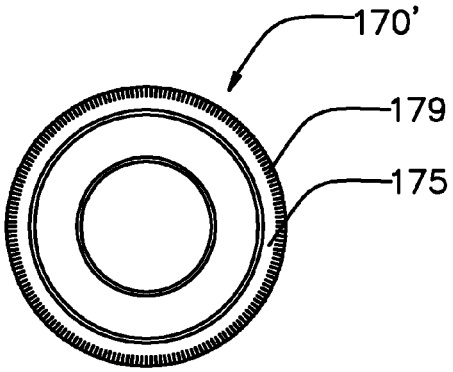
FIG. 11A illustrates an anterior schematic end view of the post illustrated in FIG. 11.

FIGS. 11 and 11A illustrate an alternate embodiment, wherein FIG. 11 illustrates a partial cross sectional view of a connector comprising a modified post 170' and FIG. 11A illustrates a schematic end view of modified post 170'. Modified post 170' comprises radial knurl 179 on rear end facing surface 175 of post flange 174 that provides high pressure contact points between front end facing surface 165 of radially inward directed collar 166 of coupling nut 160 and crests of radial knurl 179. Reducing the square inches of contact area between the surfaces increases contact pressures in PSI (pounds per square inch) when the same load is applied by the coupler system. Such increased contact pressures enhance electrical grounding characteristics.

Figure 12:
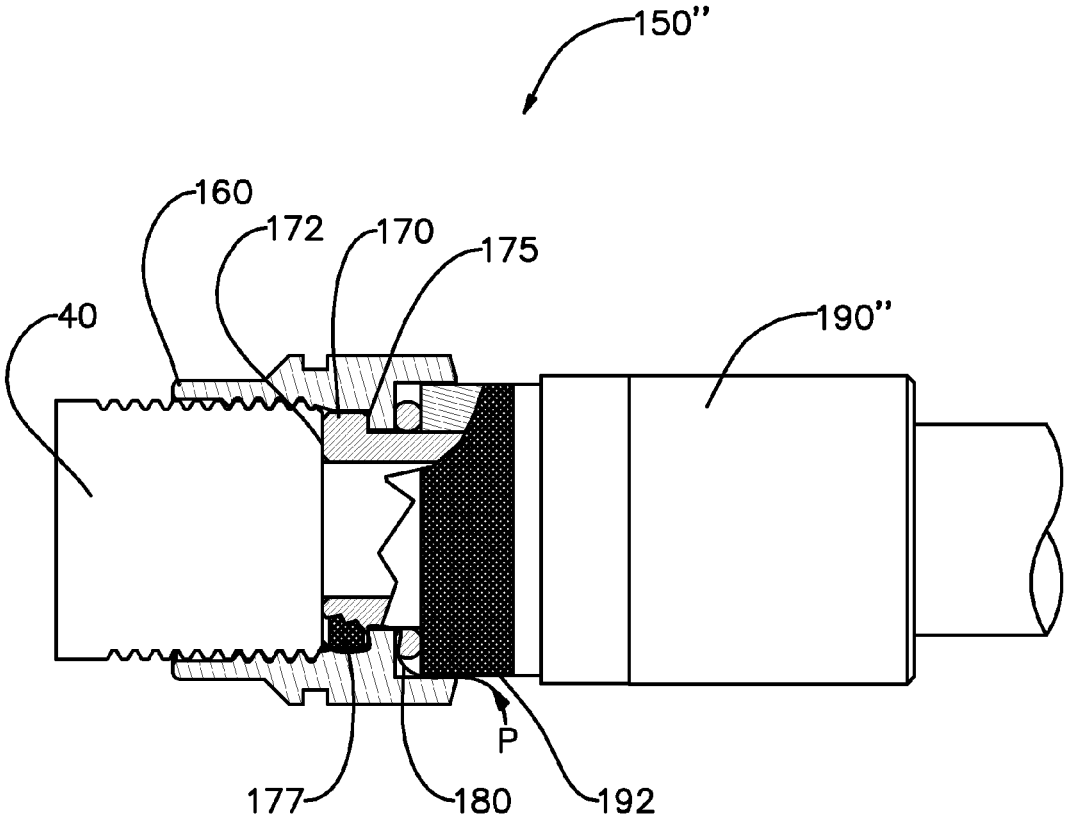
FIG. 12 illustrates a partial cross sectional view of an alternate embodiment of a connector comprising a sealing member disposed between the coupler, post, and body.

FIG. 12 illustrates a partial cross sectional view of an alternate embodiment of a connector 150" wherein sealing member 180 is disposed between the coupling nut 160, post 170, and body 190", such that an inner surface of the sealing member 180 contacts post 170 (in contrast to the connector illustrated in FIG. 4, wherein an inner surface of the sealing member 180 contacts body 190).

Figure 13:
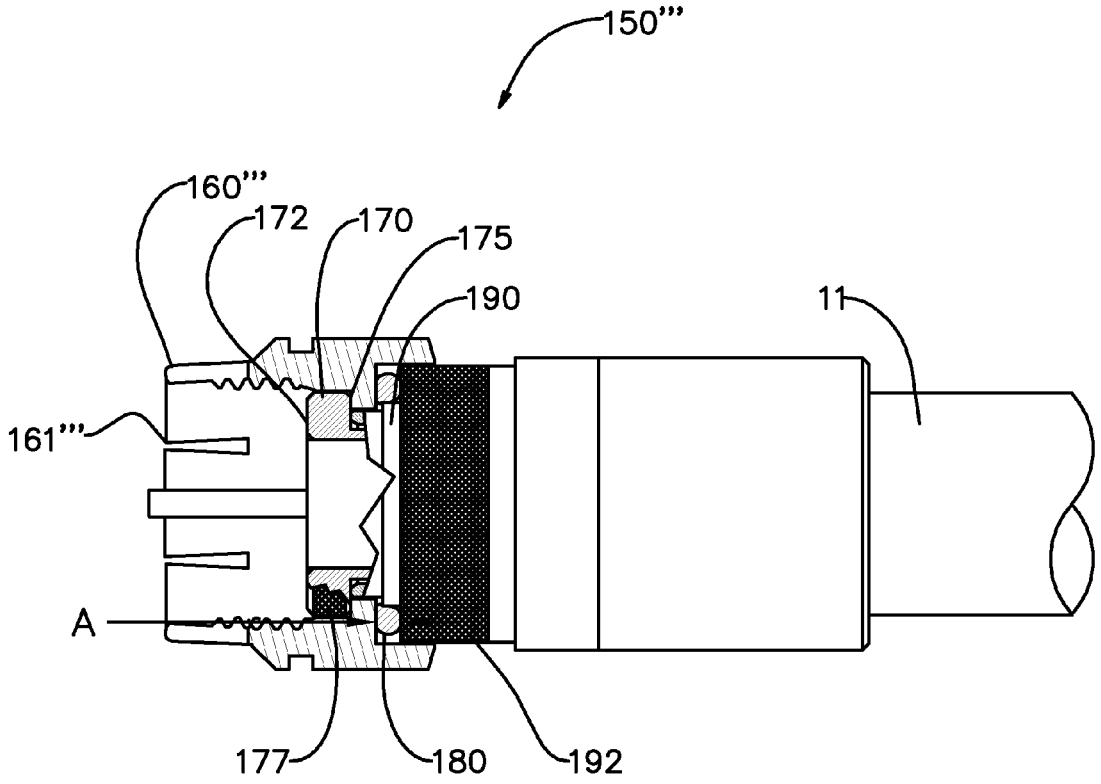
FIG. 13 illustrates a partial cross sectional view of an alternate embodiment of a connector having a coupling nut having a radially inwardly biased front end and a plurality of slots.

FIG. 13 illustrates a partial cross sectional view of an alternate embodiment of a connector 150''', wherein coupling nut 160''' has a front end that is formed or biased radially inwardly and front end of coupling nut 160''' includes a plurality of slots 161''' extending from the front end of the coupling nut between an inner and an outer surface of the front end of the coupling nut 160'''. The radially inwardly biased front end of coupling nut 160''' help insure that the threads of the coupling nut 160''' contact a mating port (not shown) and the slots allow for spring or flex back functionality to facilitate mating of the threads of the coupling nut with threads on a mating port (not shown).

Figure 14:
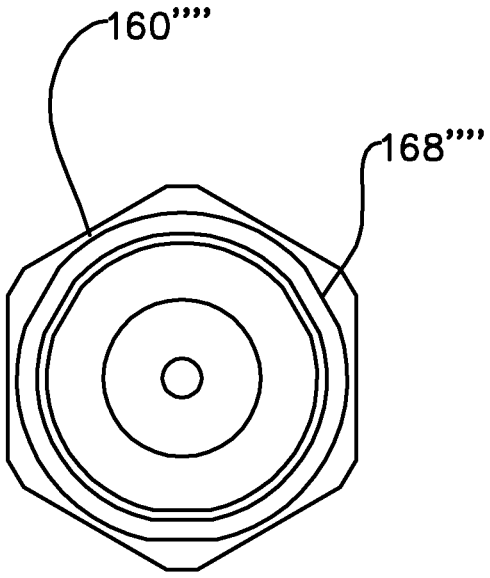
FIG. 14 illustrates a schematic front end view of an alternate embodiment of a coupling nut having an at least partially unrounded inner surface.

FIG. 14 illustrates a schematic front end view of an alternate embodiment of a coupling nut 160'''' that can be used with one or more embodiments of connectors described herein, wherein the front end of coupling nut 160'''' has an at least partially unrounded surface. Preferably, the at least partially unrounded surface is an inner surface on the front end of the coupling nut 160'''' although, as shown in FIG. 14, both inner and outer surfaces on front end of coupling nut may be unrounded. By "unrounded" it is meant that the front end of the coupling nut includes one or more intentionally introduced deformations wherein the deformations result in the front end of the coupling nut 160'''' having inner and/or outer surfaces that are not perfectly circular when viewed head on from the front end. For example, FIG. 14 illustrates a coupling nut 160'''' having a front end with intentionally introduced deformations shown as a plurality of flat spots 168'''' (flat spots 168'''' are shown in an exaggerated fashion for the purposes of illustration). The at least partially unrounded inner surface allow for the threads of the coupling nut 160''' to more positively contact a mating port (not shown).

Coaxial connectors disclosed herein can, in preferred embodiments, mitigate the effect of gapping at the connector/port interface, provide an alternative ground path, provide a means to protect from signal ingress and egress, and help ensure against further loosening of an unsecured coupler.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A coaxial connector for coupling an end of a coaxial cable to a terminal, the coaxial connector comprising:

a hollow body comprising a front end, a rear end, and an internal surface extending between the front end and the rear end, the internal surface defining a longitudinal opening;

a tubular post disposed at least partially within the longitudinal opening of the hollow body, the tubular post comprising a front end, a rear end, a tubular shank adjacent to the rear end, and a flange adjacent to the front end, wherein the flange has an outer diameter that is larger than the outer diameter of the tubular shank;

a coupling nut having a front end, and a rear end, and a radially inward directed collar with a circular aperture formed therein, wherein the circular aperture has a diameter that is less than the outer diameter of the flange of the tubular post and a front end facing surface of the radially inward directed collar rotationally engages a rear end facing surface of the flange of the tubular post;

a sealing member disposed between a rear end facing surface of the radially inward directed collar and a front end facing surface of the hollow body, wherein the sealing member is axially compressed by the rear end facing surface of the radially inward directed collar and the front end facing surface of the hollow body, wherein to the rear of the radially inward directed collar, the coupling nut comprises a rearward extending annular portion having a circular aperture formed therein, wherein the circular aperture in the rearward extending annular portion has a diameter that is greater than the circular aperture formed in the radially inward directed collar and at least a portion of an inner surface of the rearward extending annular portion contacts and circumferentially surrounds at least a portion of an outer surface of the hollow body, and wherein an outer diameter of the sealing member does not contact the inner surface of the rearward extending annular portion of the coupling nut and an annular gap extends between the outer diameter of the sealing member and the inner surface of the rearward extending annular portion of the coupling nut.

2. The coaxial connector of claim 1, wherein the sealing member comprises an O-ring.

3. The coaxial connector of claim 1, wherein the front end facing surface of the hollow body has a larger outer diameter than an outer diameter of the sealing member.

4. The coaxial connector of claim 1, wherein the sealing member has an outer diameter that is larger than the outer diameter of the flange of the post.

5. The coaxial connector of claim 1, wherein the circular aperture in the rearward extending annular portion of the coupling nut and the portion of the hollow body that is circumferentially surrounded by the rearward extending annular portion of the coupling nut each have an outer diameter that is greater than the outer diameter of the flange of the tubular post.

6. The coaxial connector of claim 1, wherein the flange of the tubular post comprises a plurality of contact points on an outer surface, wherein at least a portion of an outer surface of the contact points contact an inner surface of the coupling nut.

7. The coaxial connector of claim 6, wherein the flange of the tubular post comprises a knurled outer surface.

8. The coaxial connector of claim 1, wherein the connector further comprises an electrically conductive ground member that is press fit into an inner bore in the front end of the coupling nut.

9. The coaxial connector of claim 8, wherein the ground member comprises a plurality of radially inwardly biased fingers.

10. The coaxial connector of claim 1, wherein the coupling nut comprises an offset inner thread, wherein the annular thickness of the coupling nut between an inner surface and an outer surface varies circumferentially around the coupling nut.

11. The coaxial connector of claim 1, wherein the connector further comprises a torque aid in contact with and circumferentially surrounding at least a portion of the coupling nut.

12. The coaxial connector of claim 11, wherein the torque aid comprises a plurality of external gripping surfaces and a radially extending slot to allow the torque aid to snap over and onto the coupling nut.

13. The coaxial connector of claim 1, wherein an inner surface of the sealing member contacts the hollow body.

14. The coaxial connector of claim 1, wherein an inner surface of the sealing member contacts the tubular post.

15. The coaxial connector of claim 1, wherein the front end of the coupling nut is biased radially inwardly and the coupling nut comprises a plurality of slots extending from the front end of the coupling nut between an inner and an outer surface of the front end of the coupling nut.

16. The coaxial connector of claim 1, wherein the front end of the coupling nut comprises an inner surface that is at least partially unrounded.

17. A coaxial connector for coupling an end of a coaxial cable to a terminal, the coaxial connector comprising:

a hollow body comprising a front end, a rear end, and an internal surface extending between the front end and the rear end, the internal surface defining a longitudinal opening;

a tubular post disposed at least partially within the longitudinal opening of the hollow body, the tubular post comprising a front end, a rear end, a tubular shank adjacent to the rear end, and a flange adjacent to the front end, wherein the flange has an outer diameter that is larger than the outer diameter of the tubular shank;

a coupling nut having a front end, and a rear end, and a radially inward directed collar with a circular aperture formed therein, wherein the circular aperture has a diameter that is less than the outer diameter of the flange of the tubular post and a front end facing surface of the radially inward directed collar rotationally engages a rear end facing surface of the flange of the tubular post;

a sealing member disposed between a rear end facing surface of the radially inward directed collar and a front end facing surface of the hollow body, wherein the sealing member is axially compressed by the rear end facing surface of the radially inward directed collar and the front end facing surface of the hollow body, wherein to the rear of the radially inward directed collar, the coupling nut comprises a rearward extending annular portion having a circular aperture formed therein, wherein the circular aperture in the rearward extending annular portion has a diameter that is greater than the circular aperture formed in the radially inward directed collar and at least a portion of an inner surface of the rearward extending annular portion contacts and circumferentially surrounds at least a portion of an outer surface of the hollow body, wherein the portion of the hollow body that is circumferentially surrounded by the rearward extending annular portion of the coupling nut comprises a plurality of contact points on the outer surface, wherein at least a portion of an outer surface of the contact points contact the inner surface of the rearward extending annular portion of the coupling nut, wherein the portion of the hollow body that is circumferentially surrounded by the rearward extending annular portion of the coupling nut comprises a knurled outer surface.

* * * * *